US012195976B2

(12) United States Patent
Sun et al.

(10) Patent No.: US 12,195,976 B2
(45) Date of Patent: Jan. 14, 2025

(54) OUTDOOR LOUVERED TENT

(71) Applicant: ZHEJIANG JIANSHENG LEISURE PRODUCTS CO.,LTD, Zhejiang (CN)

(72) Inventors: Yuanru Sun, Zhejiang (CN); Chao Zeng, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 0 days.

(21) Appl. No.: 18/676,424

(22) Filed: May 28, 2024

(65) Prior Publication Data

US 2024/0352740 A1 Oct. 24, 2024

Related U.S. Application Data

(63) Continuation of application No. PCT/CN2023/093768, filed on May 12, 2023.

(30) Foreign Application Priority Data

Apr. 18, 2023 (CN) ..... 202310428929.3

(51) Int. Cl.
*E04F 10/10* (2006.01)

(52) U.S. Cl.
CPC ..... *E04F 10/10* (2013.01)

(58) Field of Classification Search
CPC . E04F 10/08; E04F 10/10; E04F 10/00; E04F 10/005; E06B 7/166
See application file for complete search history.

(56) References Cited

U.S. PATENT DOCUMENTS 2,942,658 A * 6/1960 Wilson ..... E06B 3/481 160/40
3,002,555 A * 10/1961 Goldfarb ..... E04F 10/10 160/62

(Continued)

FOREIGN PATENT DOCUMENTS

CN 211597868 9/2020
CN 111946104 11/2020

(Continued)

OTHER PUBLICATIONS

"International Search Report (Form PCT/ISA/210) of PCT/CN2023/093768", mailed on Jun. 22, 2023, pp. 1-3.

(Continued)

*Primary Examiner* — Johnnie A. Shablack
(74) *Attorney, Agent, or Firm* — JCIPRNET

(57) ABSTRACT

An outdoor louvered tent includes a louvered tent roof and a louvered tent frame for mounting the louvered tent roof. The louvered tent frame includes stand columns and a ring beam, the louvered tent roof includes several louver plates, linkage strips for linkage cooperation with several louver plates, and an overturning driving device for driving the linkage strips to move. The overturning driving device includes a linkage assembly and a driving assembly, and the driving assembly includes a control member and a mounting seat. The driving assembly is mounted on any stand column, and a stroke cavity groove for the control member to move up and down is provided in the mounting seat.

16 Claims, 15 Drawing Sheets

(56) References Cited

U.S. PATENT DOCUMENTS

| | | | | |
|---|---|---|---|---|
| 3,044,387 | A * | 7/1962 | Hinden | F24F 13/15 137/601.11 |
| 4,513,655 | A * | 4/1985 | Dayus | F24F 13/1486 49/77.1 |
| 4,527,355 | A * | 7/1985 | Numakami | E04F 10/10 49/90.1 |
| 5,873,202 | A * | 2/1999 | Parks | E04B 7/163 49/77.1 |
| 8,756,873 | B1 * | 6/2014 | Hire | E04F 10/10 49/82.1 |
| 9,145,732 | B2 * | 9/2015 | Frigerio | E04B 7/166 |
| 9,644,374 | B2 * | 5/2017 | Ivic | E04F 10/10 |
| 10,094,122 | B1 * | 10/2018 | Akbulut | E04B 7/163 |
| 10,280,625 | B2 * | 5/2019 | Byszenski | E04F 10/10 |
| 10,422,180 | B2 * | 9/2019 | Lombard | E06B 7/084 |
| 10,815,689 | B2 * | 10/2020 | Ji | E04F 10/10 |
| 10,851,544 | B1 * | 12/2020 | Volin | E04B 7/16 |
| 10,858,840 | B2 * | 12/2020 | Ji | E06B 7/086 |
| 11,015,349 | B2 * | 5/2021 | Byszenski | E04F 10/10 |
| 11,140,956 | B2 * | 10/2021 | Teblick | A47G 33/06 |
| 11,156,014 | B1 * | 10/2021 | He | E04F 10/02 |
| 11,313,131 | B2 * | 4/2022 | Terenzi | E06B 9/0676 |
| 11,421,422 | B2 * | 8/2022 | Zhao | E04F 10/10 |
| 11,486,139 | B2 * | 11/2022 | Geriavenko | E04B 7/163 |
| 11,686,101 | B2 * | 6/2023 | Liang | H02S 20/10 160/188 |
| 11,795,698 | B2 * | 10/2023 | Jackson | E04F 10/10 |
| 11,834,837 | B2 * | 12/2023 | Wang | E04F 10/10 |
| 12,037,794 | B1 * | 7/2024 | Rayburn | E04F 10/10 |
| 2010/0108113 | A1 * | 5/2010 | Taggart | F24S 20/67 135/96 |
| 2013/0056159 | A1 * | 3/2013 | Gray | E06B 7/086 160/40 |
| 2023/0101839 | A1 * | 3/2023 | Marin Rodriguez | E04F 10/10 160/62 |
| 2023/0392382 | A1 * | 12/2023 | Bontinck | E04H 6/025 |
| 2024/0068241 | A1 * | 2/2024 | Xu | E04F 10/10 |
| 2024/0200337 | A1 * | 6/2024 | Shen | F21S 9/035 |

FOREIGN PATENT DOCUMENTS

| | | |
|---|---|---|
| CN | 112854883 | 5/2021 |
| CN | 113719015 | 11/2021 |
| CN | 216043002 | 3/2022 |
| CN | 216110042 | 3/2022 |
| CN | 216713637 | 6/2022 |
| CN | 115788159 | 3/2023 |
| CN | 116733271 | 9/2023 |
| JP | 2003301578 | 10/2003 |

OTHER PUBLICATIONS

"Written Opinion of the International Searching Authority (Form PCT/ISA/237) of PCT/CN2023/093768", mailed on Jun. 22, 2023, with English translation thereof, pp. 1-7.

* cited by examiner

OUTDOOR LOUVERED TENT

CROSS-REFERENCE TO RELATED APPLICATION

This application is a continuation of international application of PCT application serial no. PCT/CN2023/093768, filed on May 12, 2023, which claims the priority benefit of China application no. 202310428929.3, filed on Apr. 18, 2023. The entirety of each of the above-mentioned patent applications is hereby incorporated by reference herein and made a part of this specification.

TECHNICAL FIELD

The present disclosure relates to the technical field of outdoor louvered tents, and in particular to an outdoor louvered tent.

TECHNICAL BACKGROUND

Outdoor tents have a variety of structural forms, such as folding tents which can be folded and stored, and fixed tents which are directly placed in outdoor courtyards and parks. For a louvered tent serving as a fixed tent, a louvered structure is employed on the tent top surface, and a louver is made to turn over by using a linkage mechanism, such that the function of shading or opening can be realized. The louvered tent is greatly liked by consumers since the tent can adjust the light by itself.

For an existing louvered tent, linkage strips usually serve as a linkage mechanism, the linkage strips are arranged in an arrangement direction of louver plates, and linkage with each louver plate is realized by means of a connecting mechanism. However, for the linkage strips in the existing louvered tent, a turbine seat is usually employed to drive a swing arm to realize linkage cooperation.

For example, the patent with No. CN111946104A relates to a multi-blade roof sunshade tent capable of bidirectionally opening and closing by 360°, which includes a tent frame. A blade top plate, a linkage strip for driving the blade top plate to open and close, and a driving mechanism are cooperatively mounted on the tent frame. The driving mechanism includes a connecting rod, a rocker arm, a worm gear assembly and a power source, the connecting rod is used for driving the linkage strip to move, the rocker arm is used for driving the connecting rod to move, the worm gear assembly is used for driving the rocker arm to rotate, and the power source is used for providing power for the worm gear assembly. However, the louver driving mechanism in the louvered tent is exposed in the middle of the louvered tent, which is very conspicuous and is not simple enough in form, affects the beauty, and also occupies space in the tent, thereby affecting the use of the louvered tent.

For this reason, currently, many louvered tents employ hidden driving structures. For example, the patent with No. CN216043002U relates to a louvered tent having a hidden louver opening and closing driving structure, which includes a tent frame assembly, several louver plates, linkage strips and the louver opening and closing driving structure. The tent frame assembly includes stand columns and ring beams which are cooperatively mounted. The louver opening and closing driving structure includes a hand-cranking mechanism, a transmission assembly and a louver transmission mechanism, the transmission assembly is used for transmitting power input by the hand-cranking mechanism to the louvered transmission mechanism, and the louver transmission mechanism is used for driving the louver plates to rotate so as to realize opening and closing of the louver plates.

For example, the patent with No. CN216713637U provides a louvered tent, which belongs to the technical field of tents. This louvered tent solves the problem of low space utilization rate of the existing louvered tent. The louvered tent includes a tent frame provided with a louver group, a foot stand for supporting the tent frame, and a driving member for driving the louver group to open and close, the tent frame is positioned at a top of the foot stand, a turbine box for driving the louver group to open and close is fixedly connected to the tent frame, and the driving member is positioned on the foot stand. The louvered tent further includes a flexible shaft and a transmission assembly positioned in the foot stand and used for transmitting power, the transmission assembly is in transmission connection to the turbine box by means of the flexible shaft, and the driving member is in transmission connection to the turbine box by means of the transmission assembly.

However, no matter how the above structure is designed, the transmission of linkage strips needs cooperation with the turbine box, and the turbine box needs to be assembled in the tent frame or a ring beam, such that the overall transmission structure is relatively complex. Moreover, the cost of the turbine box is relatively high, resulting in complex overall assembly and mounting, a high manufacturing cost and a complex transmission structure.

In addition, the louvered tent is mainly composed of a louver component, a cross beam frame body and stand columns, a plurality of bearing seats are mounted on the cross beam frame body, and louvers on the louver component are connected to the bearing seats on the beam frame body by means of bearings. The louvers can be overturned by utilizing a driving motor, such that light-transmission and ventilation gaps in the louver component can be opened or closed. However, the louver component is hinged on the cross beam frame body by means of the bearing seats, the connection structure is relatively fixed, and therefore, mounting and dismounting of a rotating shaft are relatively troublesome.

For example, a louvered tent is disclosed in the patent with No. CN116733271A, which includes a frame body and a plurality of louvers. Louver end covers are mounted at both sides of a lower portion of a top cover of each louver, the louver end covers are hinged to the frame body by means of rotating shafts, two transmission rods are arranged below the louver, and the louver end covers positioned at the same side are hinged to the same transmission rod. In the existing louvered tent, the mounting structure of a louver plate is generally that end covers are assembled at two ends of the louver plate, the louver rotating shaft is fixed in the end cover, and then the louver rotating shaft rotationally cooperates with a ring beam by means of an extension portion of the rotating shaft.

Therefore, how to realize convenient and fast assembly of the louver plate is one of the key points in the research and development of the louvered tent.

SUMMARY OF THE INVENTION

Aiming at the above problems, an objective of the present disclosure is to provide an outdoor louvered tent, such that linkage strips are conveniently driven, and characteristics of a simple structure, and convenient and fast operation are achieved.

The following technical solutions are employed to solve the technical problems of the present disclosure:

An outdoor louvered tent includes a louvered tent roof and a louvered tent frame for mounting the louvered tent roof, where the louvered tent frame includes stand columns and a ring beam, and the louvered tent roof includes several louver plates, linkage strips for linkage cooperation with several louver plates, and an overturning driving device for driving the linkage strips to move. The overturning driving device includes a linkage assembly and a driving assembly, the driving assembly includes a control member and a mounting seat, the driving assembly is mounted on any stand column, and a stroke cavity groove for the control member to move up and down is provided in the mounting seat. When the control member moves up and down along the stroke cavity groove, the control member is used for driving the linkage assembly to move, and the linkage strips are driven to move by means of the linkage assembly.

The linkage assembly includes a pull rod and a linkage member, a lower end of the pull rod is used for being cooperatively assembled with the control member, an upper end of the pull rod is used for being cooperatively assembled with the linkage member, and the linkage member is further cooperatively assembled with the linkage strip.

The linkage member includes a first linkage arm, a linkage shaft and a second linkage arm, one end of the first linkage arm is used for being cooperatively assembled with the upper end of the pull rod, and the other end of the first linkage arm is used for being cooperatively assembled with the linkage shaft. The other end of the linkage shaft is cooperatively assembled with one end of the second linkage arm, and the other end of the second linkage arm is cooperatively assembled with the linkage strip.

The pull rod is located in an inner cavity of the stand column, and the upper end of the pull rod protrudes from an upper end of the stand column and extends upwards. The stand column is provided with an alignment stroke hole, the alignment stroke hole is used for corresponding to an outer port of the stroke cavity groove, and the mounting seat is fixed in an inner cavity of the stand column.

The control member includes a handle, a handle shaft and a locking mechanism, the handle fixedly cooperates with the handle shaft, the handle is positioned outside the stand column, and the handle shaft penetrates a side wall of the stand column and extends into the inner cavity of the stand column. The handle shaft is cooperatively assembled with the lower end of the pull rod positioned in the inner cavity of the stand column, and the handle shaft penetrates the stroke cavity groove and is capable of stopping at any height in the stroke cavity groove.

The locking mechanism includes a lock cylinder shaft, the lock cylinder shaft is embedded in an inner cavity of the handle shaft, and a locking shaft penetrates the lock cylinder shaft. A guide hole is provided in a side wall of the handle shaft, and the locking shaft correspondingly cooperates with the guide hole. A limit pin is arranged at an inner end of the lock cylinder shaft, a limit pin hole is provided in the side wall of the handle shaft, and the limit pin correspondingly cooperates with the limit pin hole. The locking shaft is used for locking cooperation with the mounting seat, such that the handle shaft is capable of stopping at any height in the stroke cavity groove.

A spring cavity is provided in the lock cylinder shaft, and a return spring is arranged in the spring cavity. One end of the return spring abuts against the locking shaft, and the other end of the return spring abuts against the limit pin. A guide rail is further cooperatively arranged on the handle shaft, the guide rail fills the stroke cavity groove, and is capable of moving up and down along the stroke cavity groove, and a height size of the guide rail is larger than a stroke height size of the stroke cavity groove. At least two locking grooves are provided in the mounting seat, and an outer end of the lock cylinder shaft is cooperatively provided with a button cap. When the lock cylinder shaft axially moves towards the inner cavity of the stand column, the locking shaft is capable of being separated from the locking groove, and the handle shaft is capable of moving up and down along the stroke cavity groove.

The louvered tent roof includes several louver units and a linkage assembly for driving the louver units to open and close, the louver unit includes two louver plates, adjacent positions of the louver plates in the same louver unit are hinged in a cooperative manner, and the linkage assembly is used for driving any louver plate in the louver unit to turn over, such that the other louver plate in the same louver unit turns over in linkage. The two louver plates in the same louver unit are a driving louver plate and a driven louver plate respectively, when the driving louver plate is driven to close by the linkage assembly, the driven louver plate is linked to close, and the louver plates between adjacent louver units are adjacent to each other. When the driving louver plate is driven to open by the linkage assembly, the driven louver plate is linked to open, and the louver plates between adjacent louver units are gradually separated. As the louvered tent roof changes from an open state to a closed state, an included angle between the driving louver plate and the driven louver plate in any louver unit is gradually increased, and adjacent louver units are separated at intervals.

The linkage assembly includes linkage strips, the linkage strips are arranged in an extension manner in an arrangement direction of several of louver units, and one louver plate in the louver unit is hinged to the linkage strip by means of a linkage seat.

The outdoor louvered tent further includes a sliding rail. Several hinged seats are arranged on the sliding rail, each hinged seat is used for hinged cooperation with a single louver plate, and the louver plate is a louver plate used for cooperating with the linkage strip in the louver unit. A sliding groove is further provided in the sliding rail, and the other louver plate in the louver unit cooperates with the sliding groove by means of a guide shaft.

The sliding rail is arranged at an inner side of a ring beam frame, and the sliding rail is arranged on one side or two sides.

Several louver plates are cooperatively assembled with the ring beam, and the ring beam includes end ring beams and side ring beams. Two ends of the louver plate are used for cooperating with the side ring beams, and several louver rotating shafts are mounted on inner side walls of the side ring beams. The louver plate includes a louver plate body, louver plate end covers positioned at two ends of the louver plate body, and rotating shaft seats positioned at two ends of the louver plate body, the rotating shaft seats are used for rotating cooperation with the louver rotating shafts, and at least the rotating shaft seat at one end of the louver plate body cooperates with the corresponding louver rotating shaft and then is provided with a clamp member. A rotating shaft fixing seat is arranged on the inner side wall of the side ring beam, and the louver rotating shaft fixedly cooperates with the rotating shaft fixing seat.

Both ends of the louver plate body are provided with mounting grooves, and both sides of the mounting groove each are provided with a fixing hole. The rotating shaft seat includes a rotating shaft seat body and fixing plates located on both sides of the rotating shaft seat body, alignment holes are provided in the fixing plates, and the alignment holes are used for corresponding cooperating with the fixing holes. The rotating shaft seat body is clamped and embedded in the mounting groove.

A rotating shaft cavity is provided in the rotating shaft seat body. A clamping insert seat is arranged at one side of the rotating shaft seat body, a clamping insert groove is provided at the side of the clamping insert seat, and the clamping insert groove is used for cooperating with the clamp member.

The clamping insert seat includes a rotating shaft butt seat and a clamp seat, the rotating shaft butt seat is positioned outside the clamp seat, and an end surface of the rotating shaft butt seat is of a rotating shaft cavity port. The clamping insert grooves are positioned on both sides of the clamp seat, and the clamping insert grooves are in communication with the rotating shaft cavity. A rotating shaft through hole is provided in the louver plate end cover, the louver rotating shaft penetrates the rotating shaft through hole, and the rotating shaft through hole is used for corresponding to the rotating shaft cavity port.

The clamp member includes a clamp opening portion, a clamp portion and a clamp body, the clamp portion is used for correspondingly cooperating with the clamping insert groove and is in clamp cooperation with the louver rotating shaft positioned in the rotating shaft cavity by means of the clamping insert groove.

The louver rotating shaft includes a rotating shaft body and a shaft sleeve arranged on the rotating shaft body in a sleeving manner, a clamp groove is provided between the rotating shaft body and the shaft sleeve, and the clamp portion correspondingly cooperates with the clamp groove.

The rotating shaft seats positioned at the two ends of the louver plate body are a first rotating shaft seat and a second rotating shaft seat respectively, and the louver plate end covers positioned at the two ends of the louver plate body are a first end cover and a second end cover respectively. The first end cover adjacently cooperates with the first rotating shaft seat, and the second end cover adjacently cooperates with the second rotating shaft seat. The first rotating shaft seat cooperates with the corresponding louver rotating shaft and then is provided with the clamp member, and the linkage strip is cooperatively arranged on the first end cover.

Compared with the prior art, the present disclosure has the following beneficial effects: according to the present disclosure, the overturning driving device is designed in an optimized manner, and the pull rod is driven by the control member to realize transmission. By means of hard transmission of the pull rod, the linkage strips can realize rapid linkage cooperation by means of the linkage member in combination with up-and-down movement of the control member, thereby completing overturning operation of the louver plate. The driving assembly is optimized, and up-and-down pushing operation is realized by directly using the control member, such that the operation is simpler and more effective. Different overturning angles of the louver plate can be adjusted by means of stop at different height positions.

Features of the present disclosure may be clearly understood with reference to the accompanying drawings and the following detailed description of preferred embodiments.

DETAILED DESCRIPTION OF THE EMBODIMENTS

Figure 1:
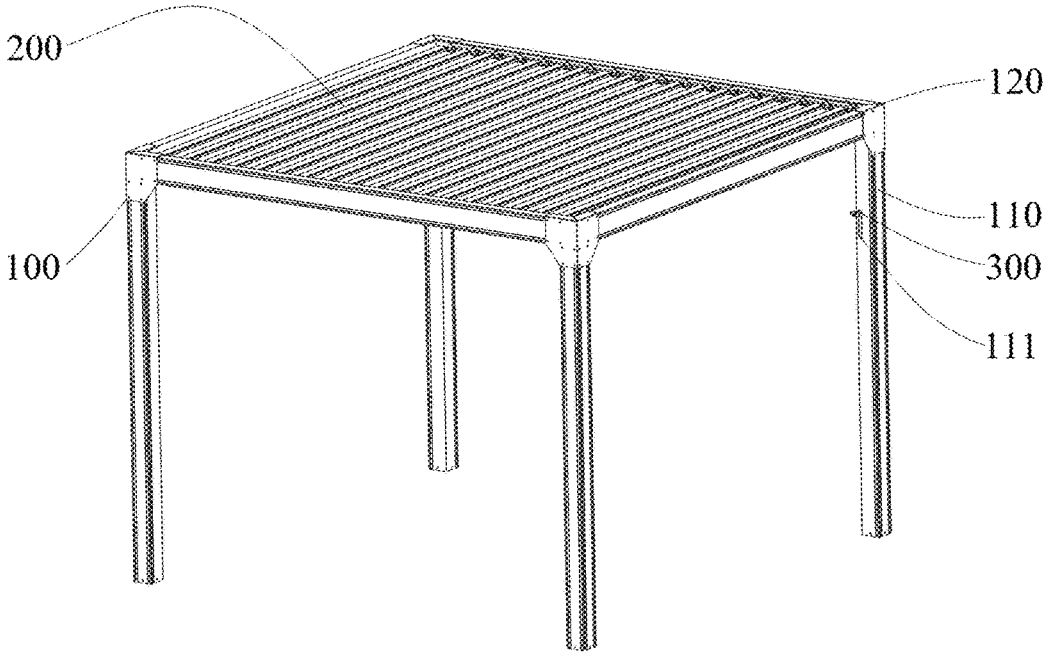
FIG. 1 is a schematic diagram of an integral structure of an outdoor louvered tent in Example 1 of the present disclosure.

In order to make it easy to understand the technical means, creative features, objectives and effects achieved by the present disclosure, the present disclosure is further described in combination with particular diagrams.

Example 1

In combination with FIGS. 1-10, an outdoor louvered tent is disclosed in this example. The outdoor louvered tent includes a louvered tent roof 200 and a louvered tent frame 100 for mounting the louvered tent roof, and the louvered tent frame 100 includes stand columns 110 and a ring beam 120. Based on the louvered tents with different specifications in the prior art, the number of the stand columns 110 is at least two, and in a preferred example, the number of the stand columns 110 is four. The ring beam 120 is of a rectangular frame structure, and the stand columns 110 and the ring beam 120 are correspondingly and fixedly mounted in a cooperative manner. The louvered tent roof 200 includes several louver plates 210, linkage strips 220 for linkage cooperation with several louver plates 210, and an overturning driving device for driving the linkage strips 220 to move. After the overturning driving device drives the linkage strips 220 to move, the linkage strips 220 drive several louver plates 210 to overturn, thereby completing opening and closing of the louver plates 210.

In this example, the overturning driving device includes a linkage assembly 400 and a driving assembly 300. The driving assembly 300 includes a control member 310 and a mounting seat 320, the driving assembly 300 is mounted on any stand column 100, and a stroke cavity groove 321 for the control member 310 to move up and down is provided in the mounting seat 320. When the control member 310 moves up and down along the stroke cavity groove 321, the control member 310 is used for driving the linkage assembly 400 to move, and the linkage strips 220 are driven to move by means of the linkage assembly 400. Built-in transmission of the driving assembly 300 is realized by using the structure of the stand columns 110 in combination with mounting of the driving assembly 300. Moreover, preferably, up-and-down push and pull operation is employed, such that the operation manner is simplified, and operation by a user is more convenient and faster.

In a specific structure, the linkage assembly 400 includes a pull rod 410 and a linkage member 420, a lower end of the pull rod 410 is used for being cooperatively assembled with the control member 310, an upper end of the pull rod 410 is used for being cooperatively assembled with the linkage member 420, and the linkage member 420 is further cooperatively assembled with the linkage strip 220. The linkage assembly 400 is used for realizing power transmission, and the control member 310 is used for realizing power input. After the user operates the control member 310 to move up and down, the pull rod 410 is driven to move up and down, and the pull rod 410 pulls the linkage member 420 to deflect, such that the linkage member 420 drives the linkage strip 220 to complete the movement, and finally, the opening and closing operation of the louver plate 210 is completed.

Figure 2:
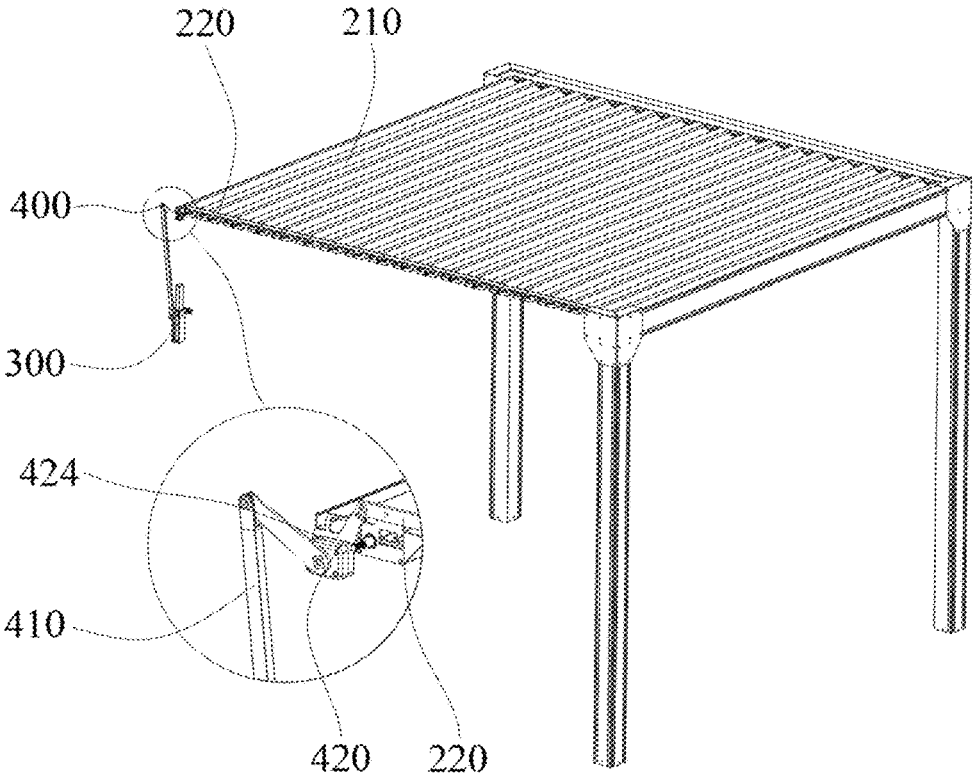
FIG. 2 is a schematic structural diagram of an overturning driving device in Example 1 of the present disclosure.
Figure 3:
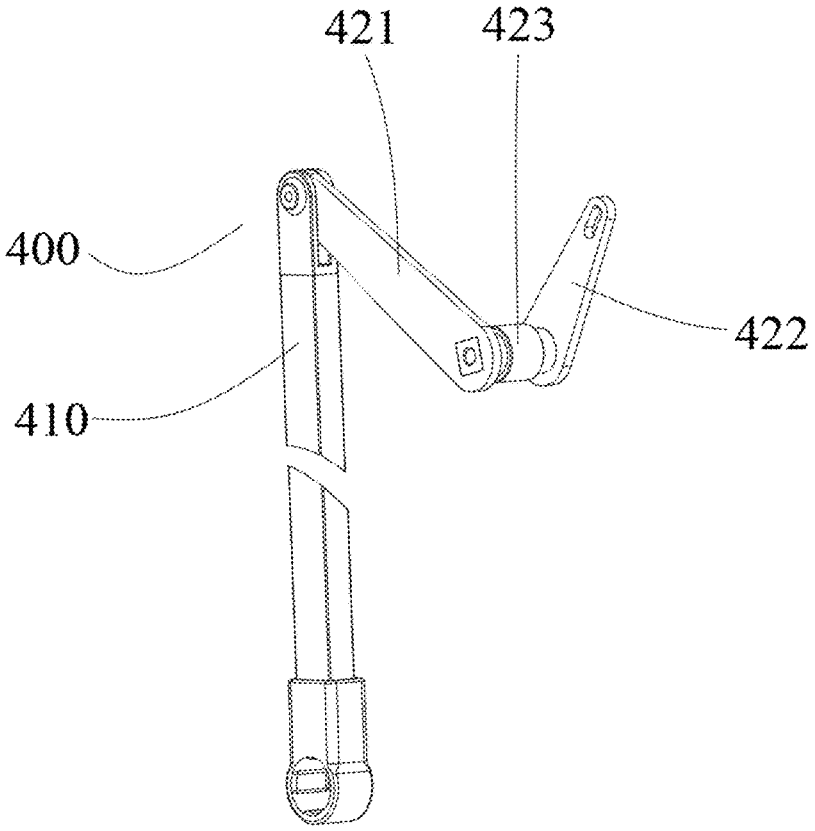
FIG. 3 is schematic structural diagram I of a linkage assembly in Example 1 of the present disclosure.

In combination with the above description, in one preferred example, referring to FIGS. 2 and 3, the linkage member 420 includes a first linkage arm 421, a linkage shaft 423 and a second linkage arm 422, and an outer end of the linkage shaft 423 is usually cooperatively provided with a housing 424, so as to increase protection to the linkage shaft 423. One end of the first linkage arm 421 is used for being cooperatively assembled with the upper end of the pull rod 410, and hinged cooperation is usually employed. The upper end of the pull rod 410 is usually provided with a lug seat structure, thereby conveniently realizing hinged cooperation with the first linkage arm 421. The other end of the first linkage arm 421 is cooperatively assembled with the linkage shaft 423, so as to drive the linkage shaft 423 to realize rotation. The other end of the linkage shaft 423 is cooperatively assembled with one end of the second linkage arm 422, such that the linkage shaft 423 is used for driving the second linkage arm 422 to realize deviation. The other end of the second linkage arm 422 is cooperatively assembled with the linkage strip 220, so as to realize transmission driving of the linkage strip 220.

Figure 4:
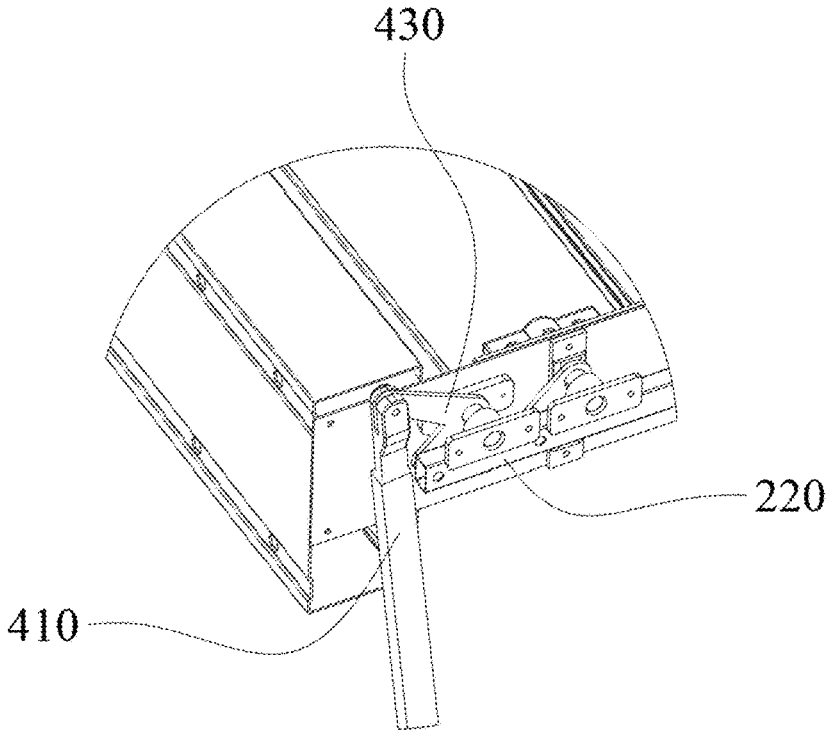
FIG. 4 is schematic structural diagram II of a linkage assembly in Example 1 of the present disclosure.
Figure 5:
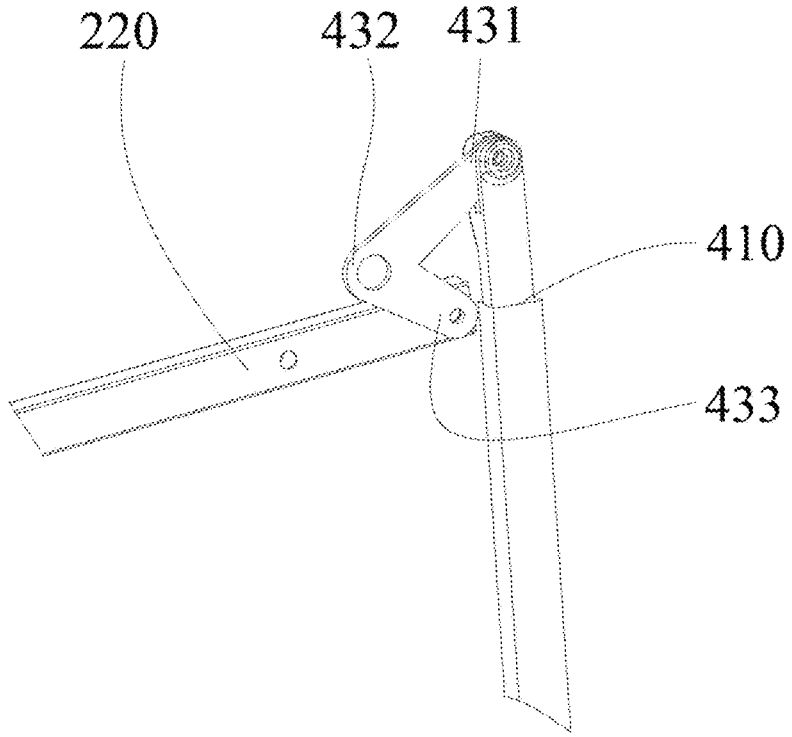
FIG. 5 is schematic structural diagram III of a linkage assembly in Example 1 of the present disclosure.
Figure 6:
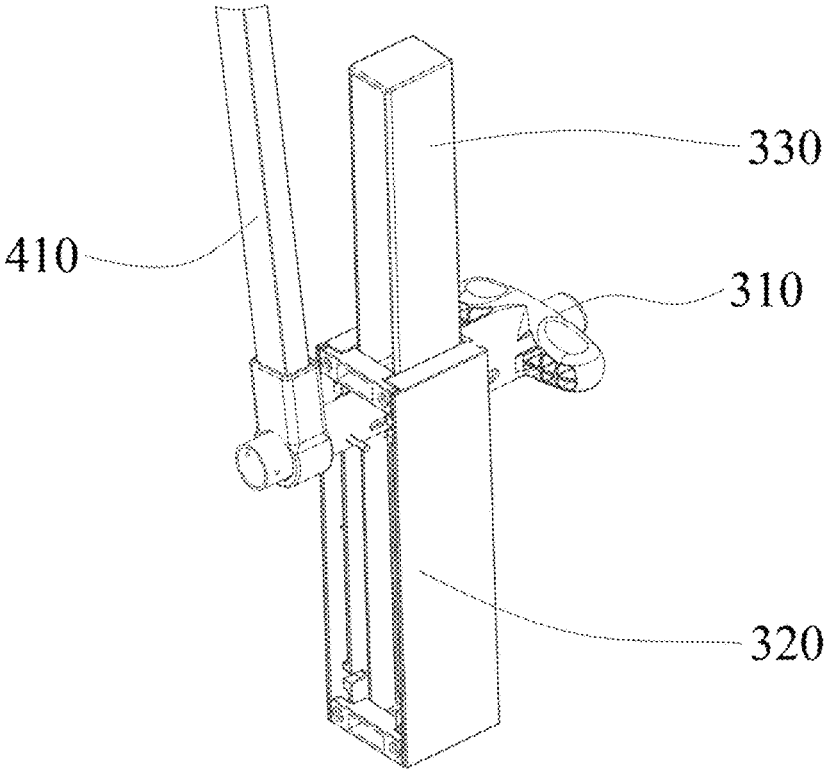
FIG. 6 is a schematic diagram of an integral structure of a driving assembly in Example 1 of the present disclosure.
Figure 7:
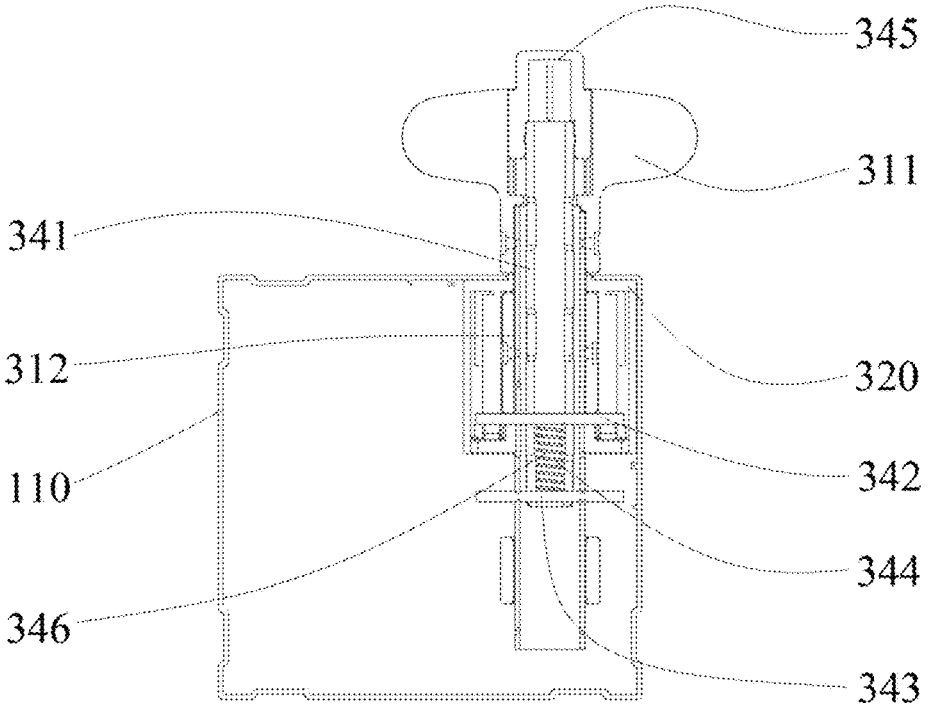
FIG. 7 is a schematic structural diagram of a driving assembly from a sectional view in Example 1 of the present disclosure.
Figure 8:
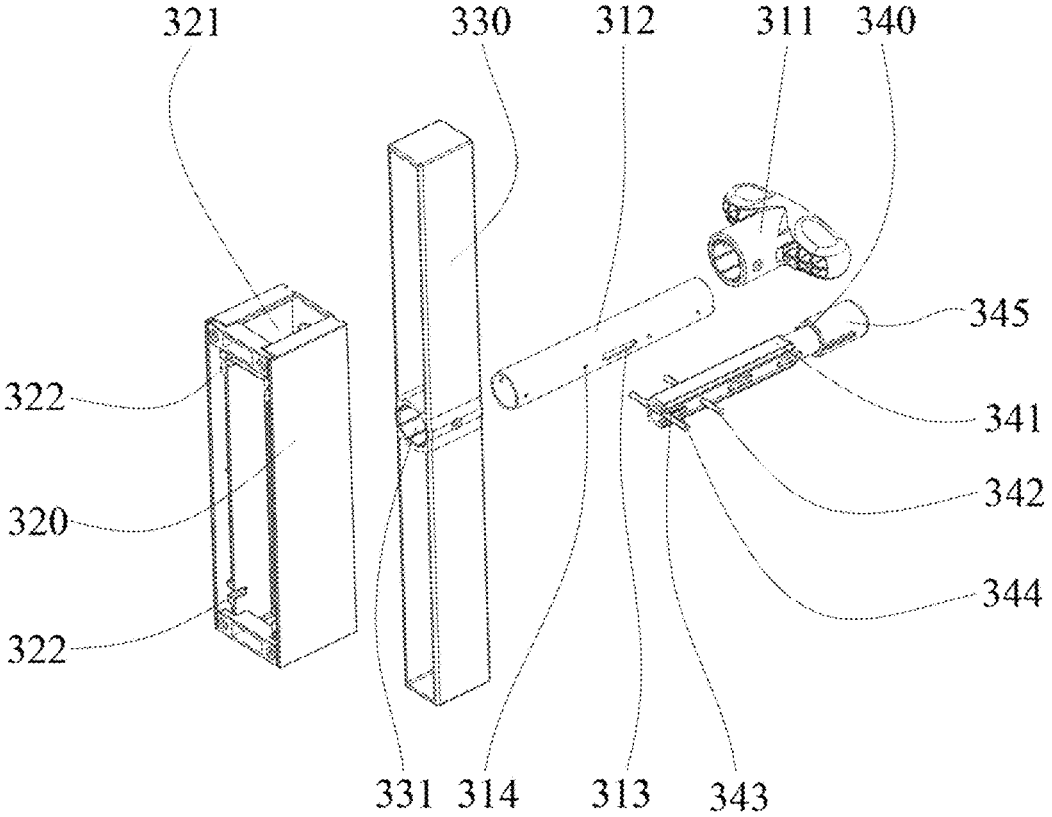
FIG. 8 is an exploded schematic structural diagram of a driving assembly in Example 1 of the present disclosure.
Figure 9:
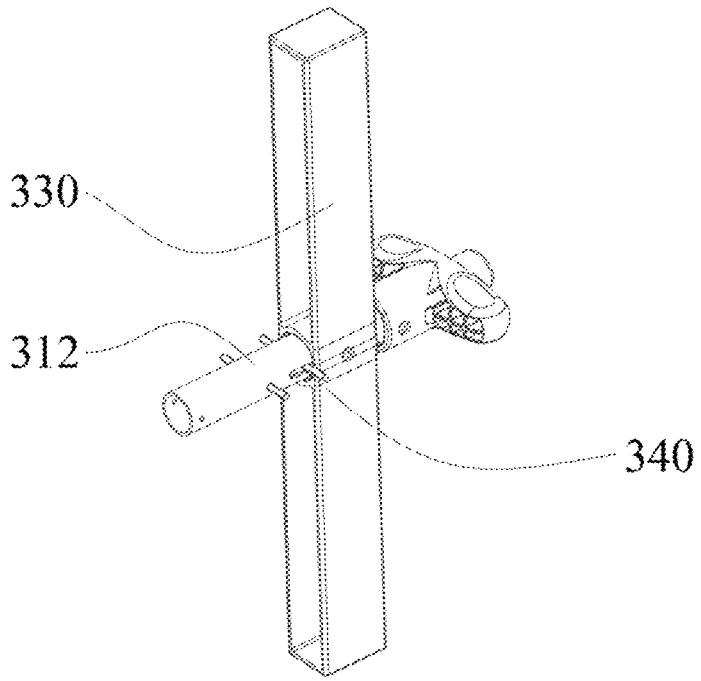
FIG. 9 is a schematic structural diagram of assembly between a handle shaft and a guide rail in Example 1 of the present disclosure.
Figure 10:
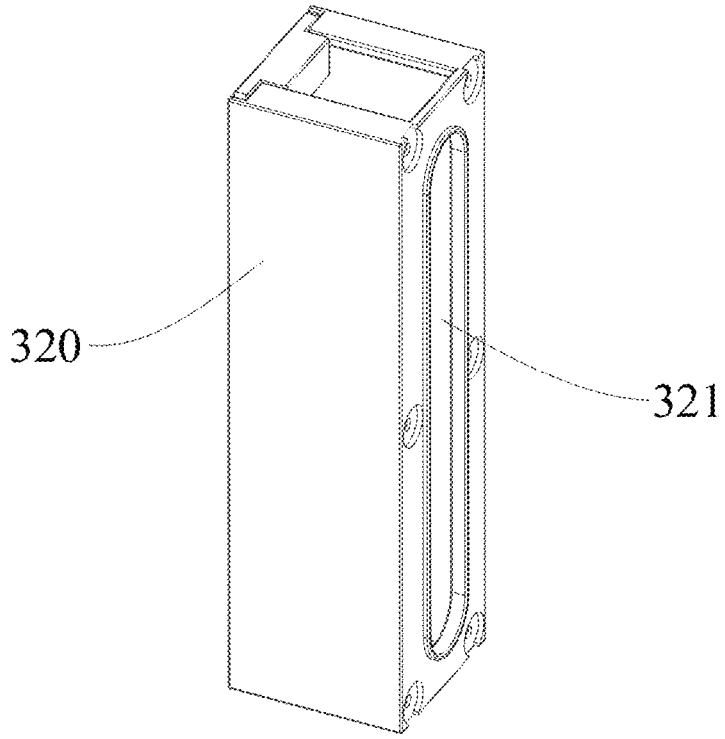
FIG. 10 is a schematic structural diagram of a mounting seat in Example 1 of the present disclosure.
Figure 11:
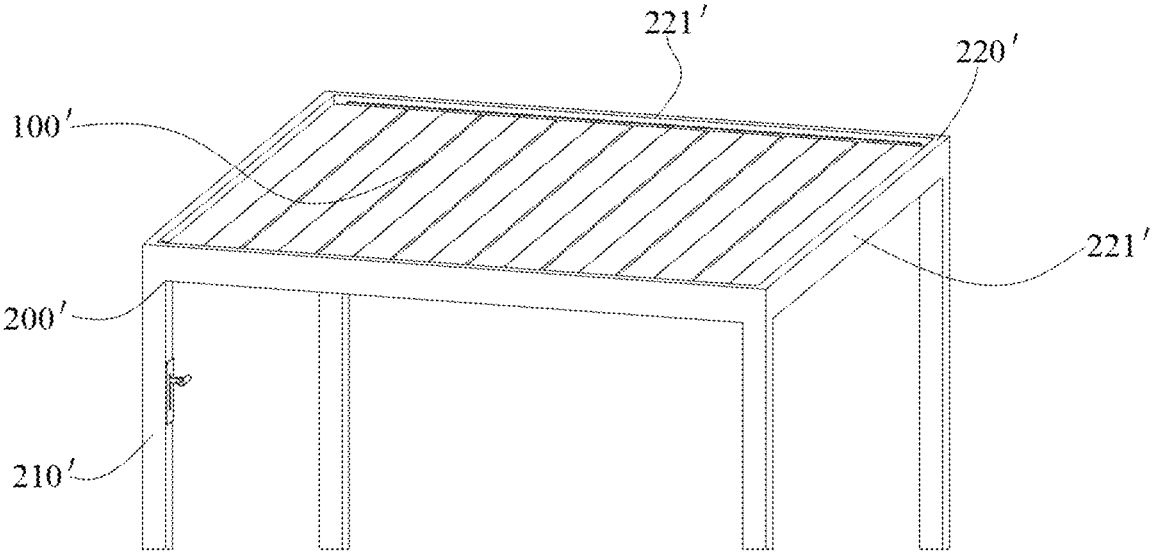
FIG. 11 is a schematic structural diagram of an integral louvered tent roof in a closed state in Example 2 of the present disclosure.
Figure 12:
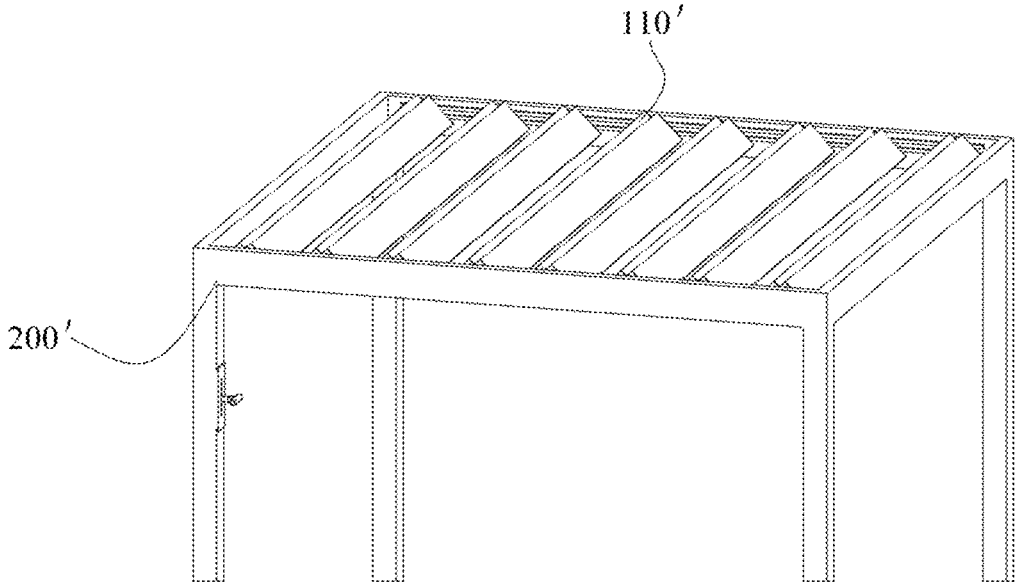
FIG. 12 is a schematic structural diagram of an integral louvered tent roof in a half-opened state in Example 2 of the present disclosure.
Figure 13:
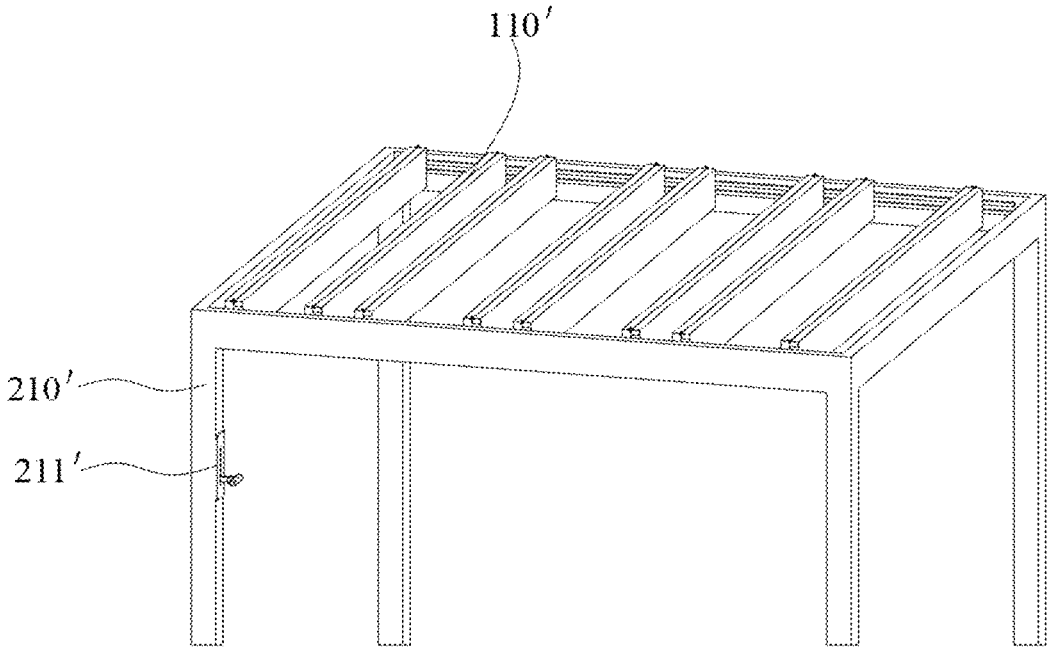
FIG. 13 is schematic structural diagram I of an integral louvered tent roof in a completely opened state in Example 2 of the present disclosure.
Figure 14:
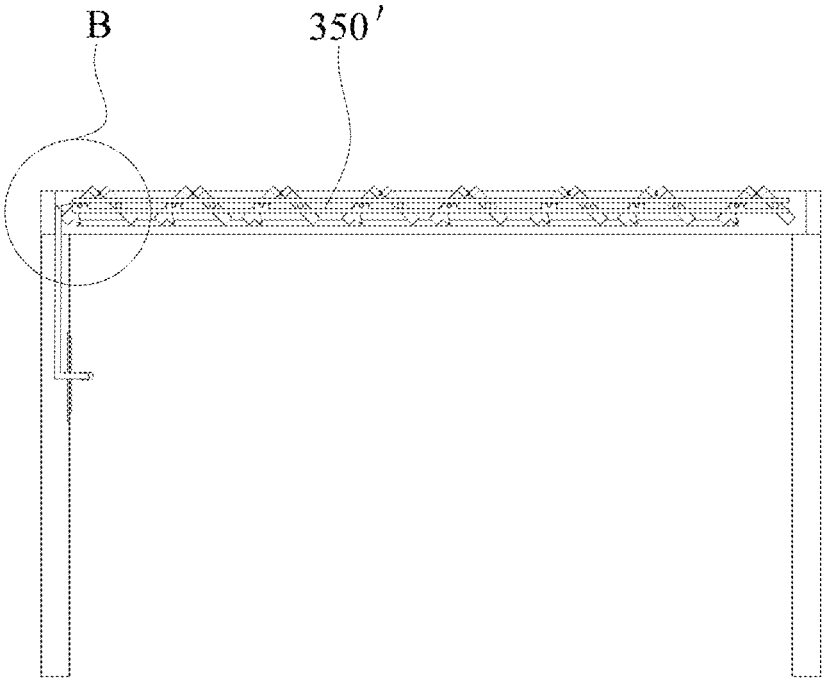
FIG. 14 is a schematic structural diagram of cooperation between a louver unit and a sliding rail in Example 2 of the present disclosure.
Figure 15:
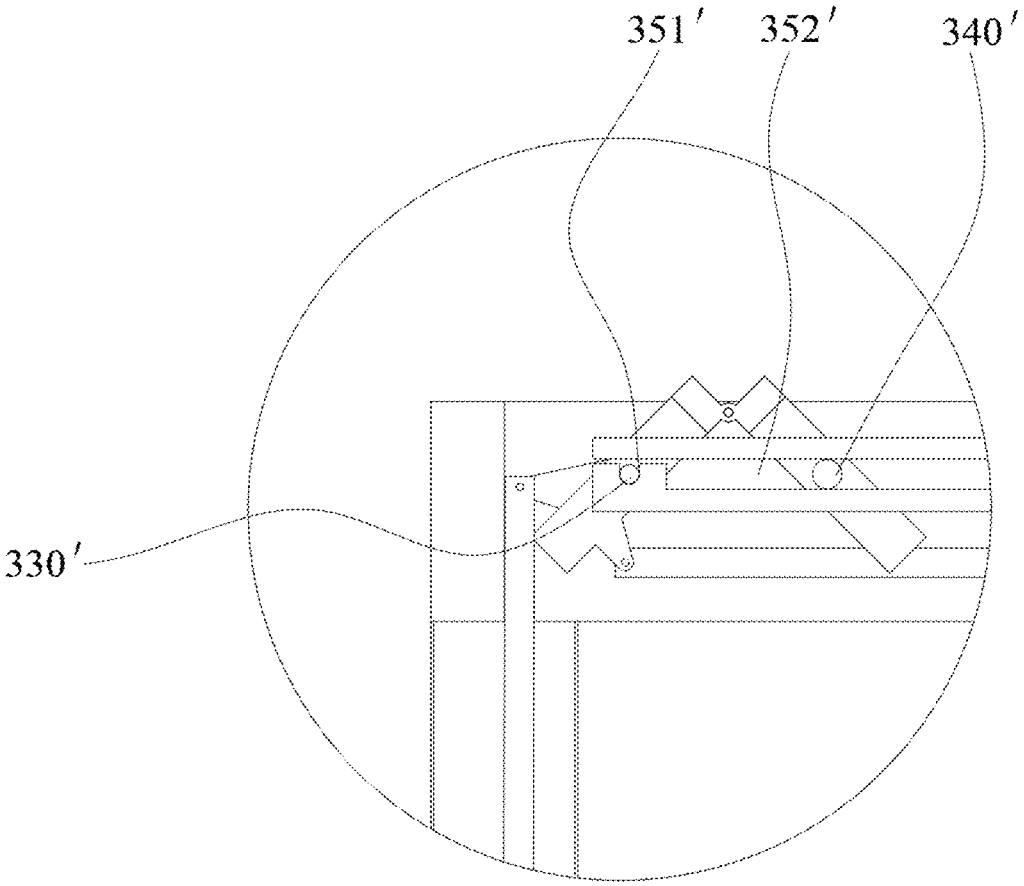
FIG. 15 is a partially enlarged schematic structural diagram of portion B in FIG. 14 of Example 2 of the present disclosure.
Figure 16:
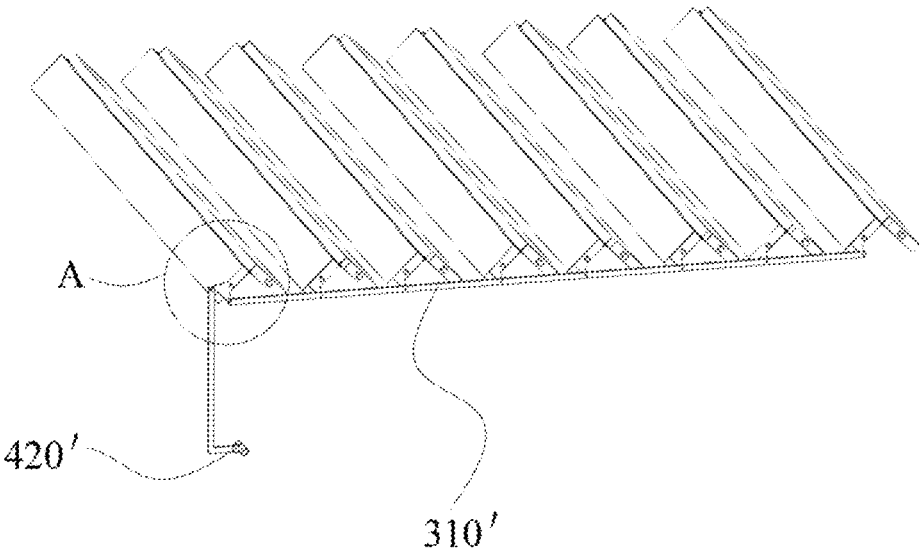
FIG. 16 is a schematic structural diagram of a louver unit and a linkage strip in Example 2 of the present disclosure.
Figure 17:
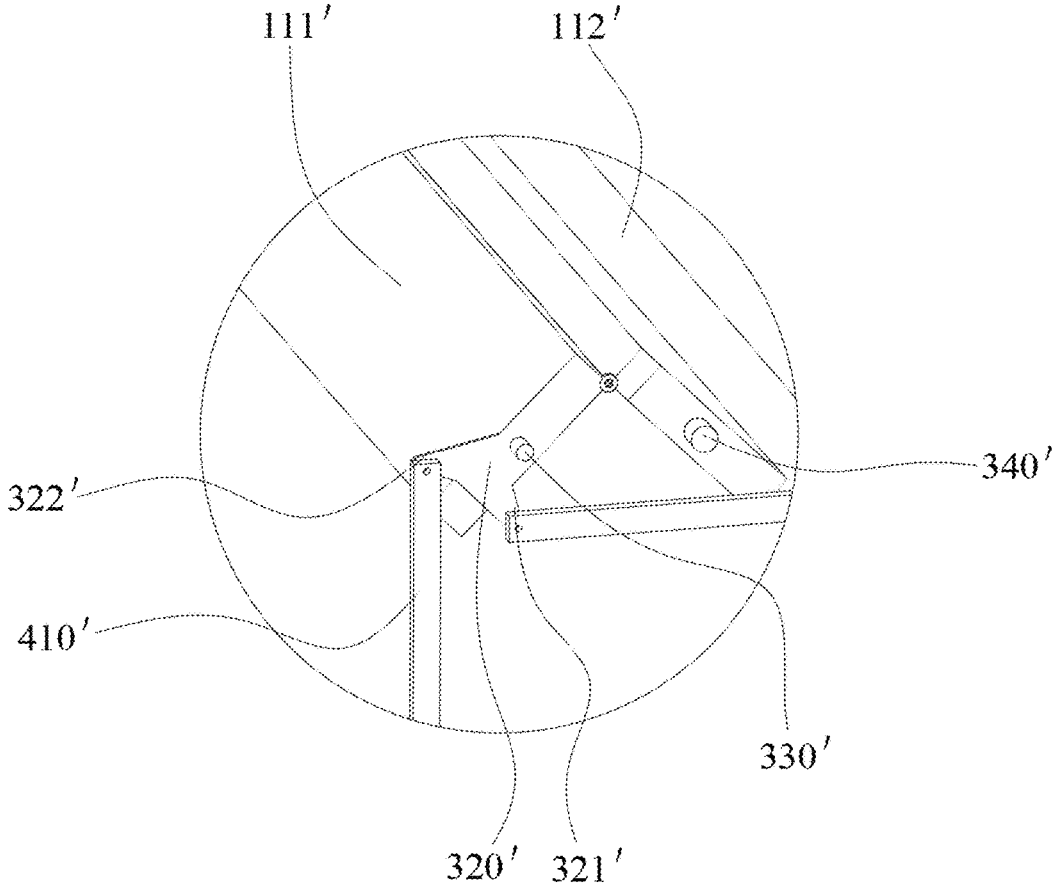
FIG. 17 is a partially enlarged schematic structural diagram of portion A in FIG. 16 of Example 2 of the present disclosure.
Figure 18:
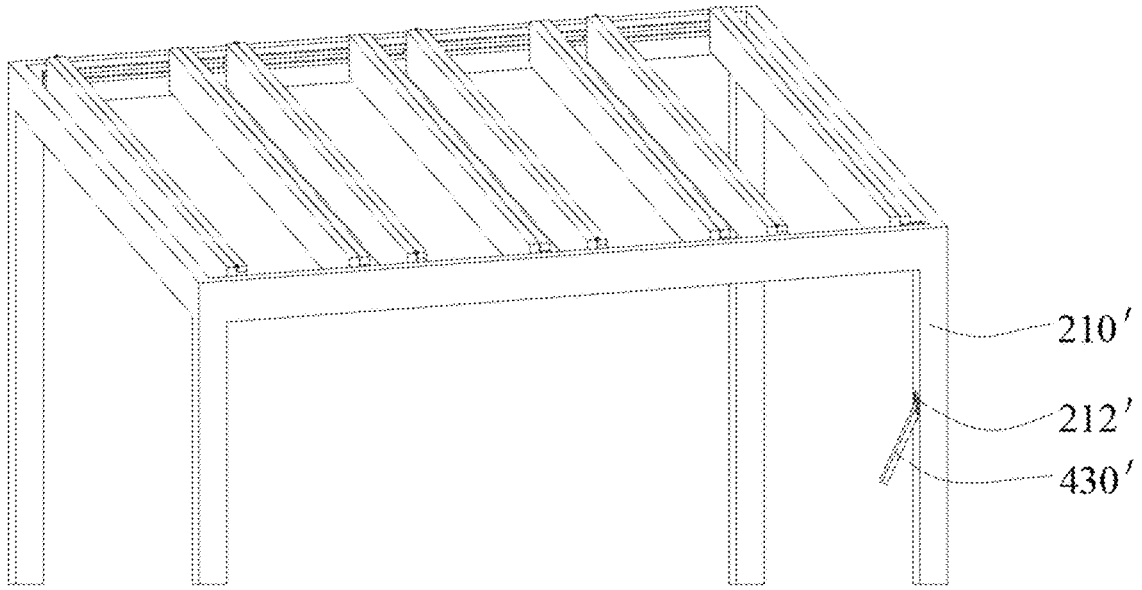
FIG. 18 is schematic structural diagram II of an integral louvered tent roof in a completely opened state in Example 2 of the present disclosure.
Figure 19:
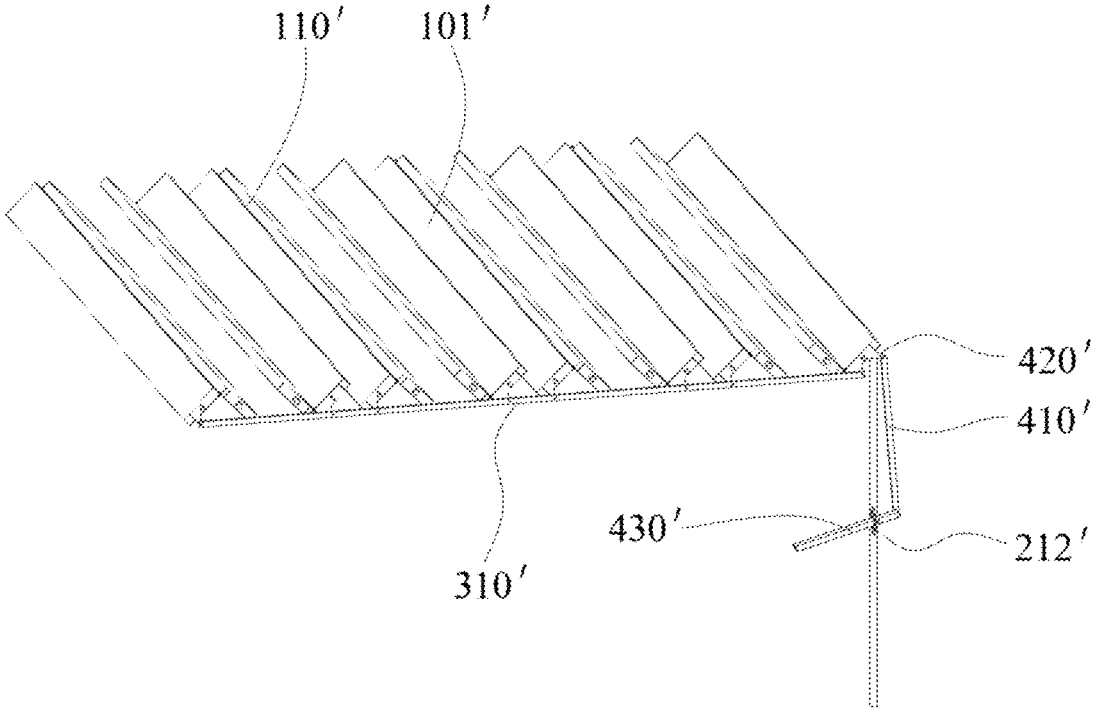
FIG. 19 is a schematic structural diagram of a louvered tent roof in a completely opened state in Example 2 of the present disclosure.
Figure 20:
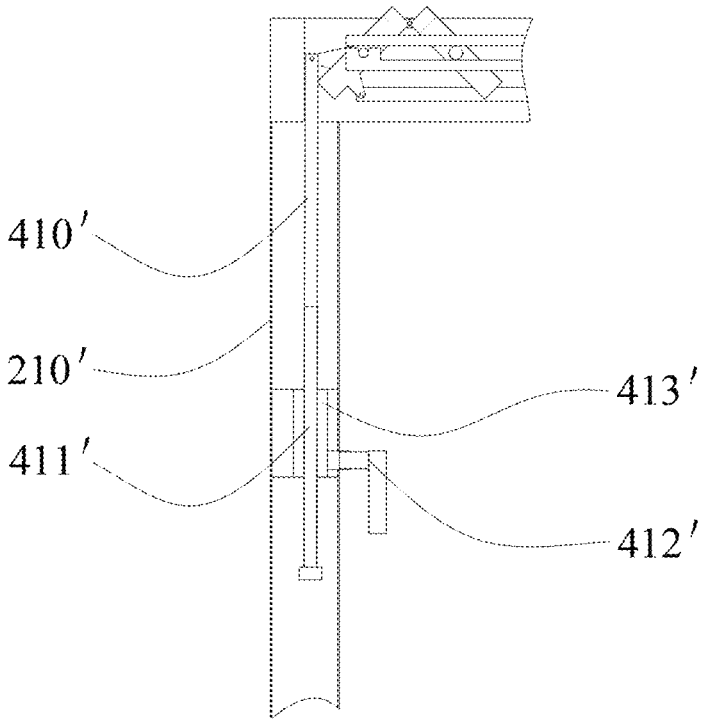
FIG. 20 is schematic structural diagram I of a driving mechanism in Example 2 of the present disclosure.
Figure 21:
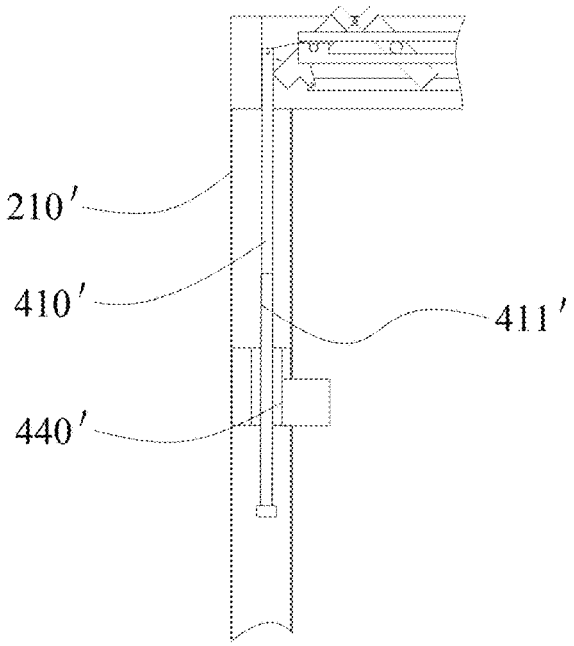
FIG. 21 is schematic structural diagram II of a driving mechanism in Example 2 of the present disclosure.
Figure 22:
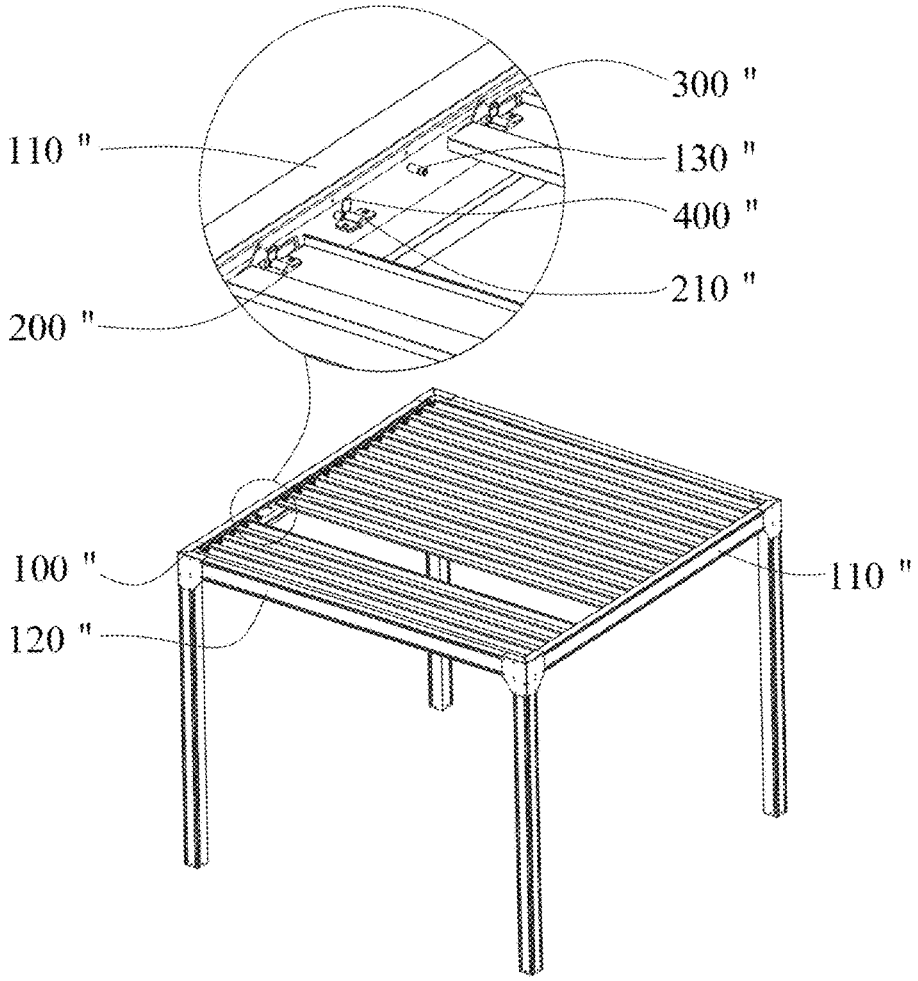
FIG. 22 is a schematic diagram of an integral structure of Example 3 of the present disclosure.
Figure 23:
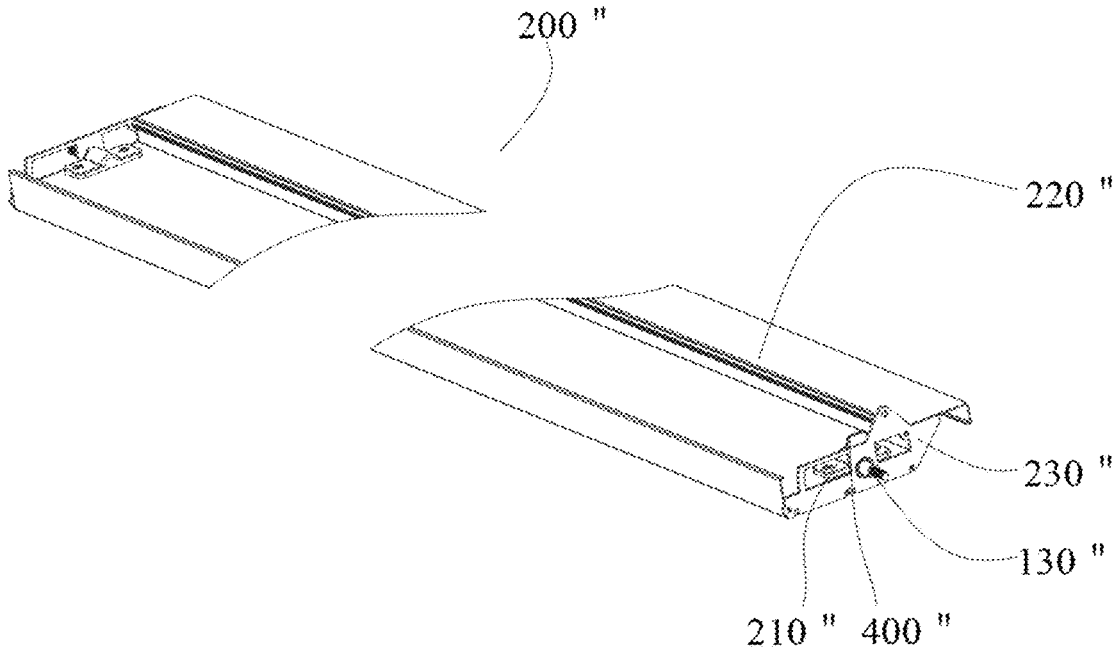
FIG. 23 is a schematic structural diagram of assembly between a louver plate and a louver rotating shaft in Example 3 of the present disclosure.
Figure 24:
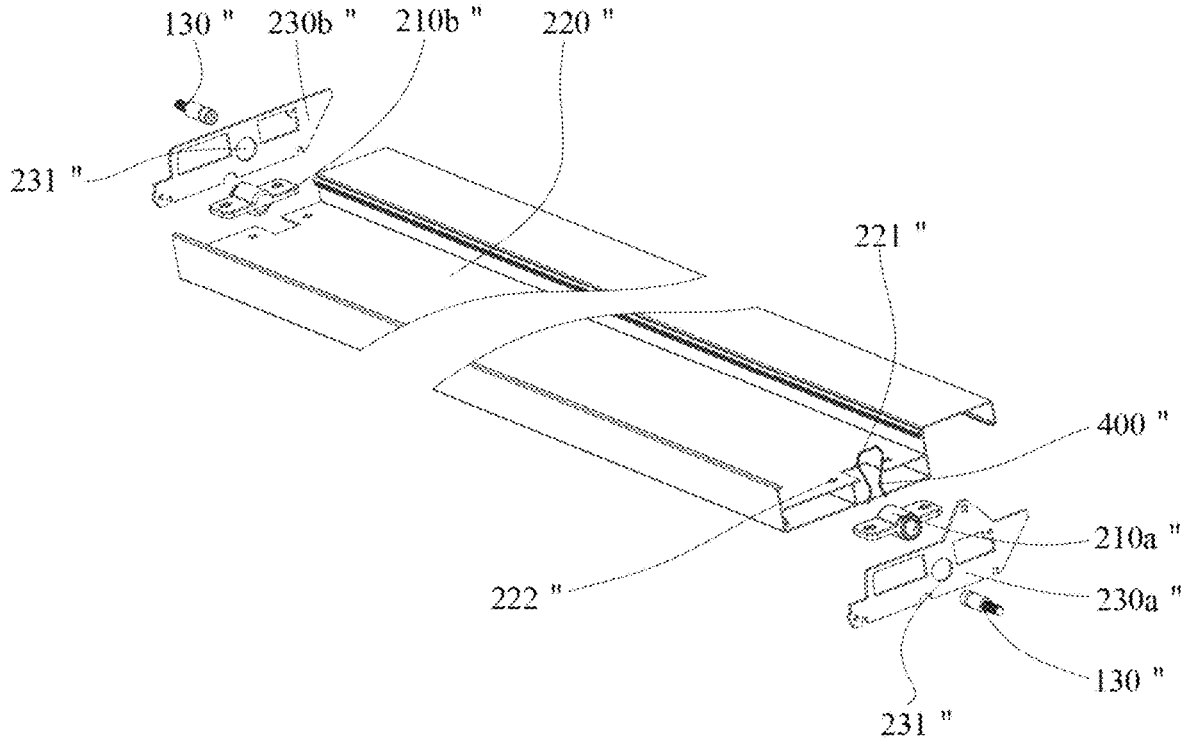
FIG. 24 is a schematic structural diagram of disassembly between a louver plate and a louver rotating shaft in Example 3 of the present disclosure.
Figure 25:
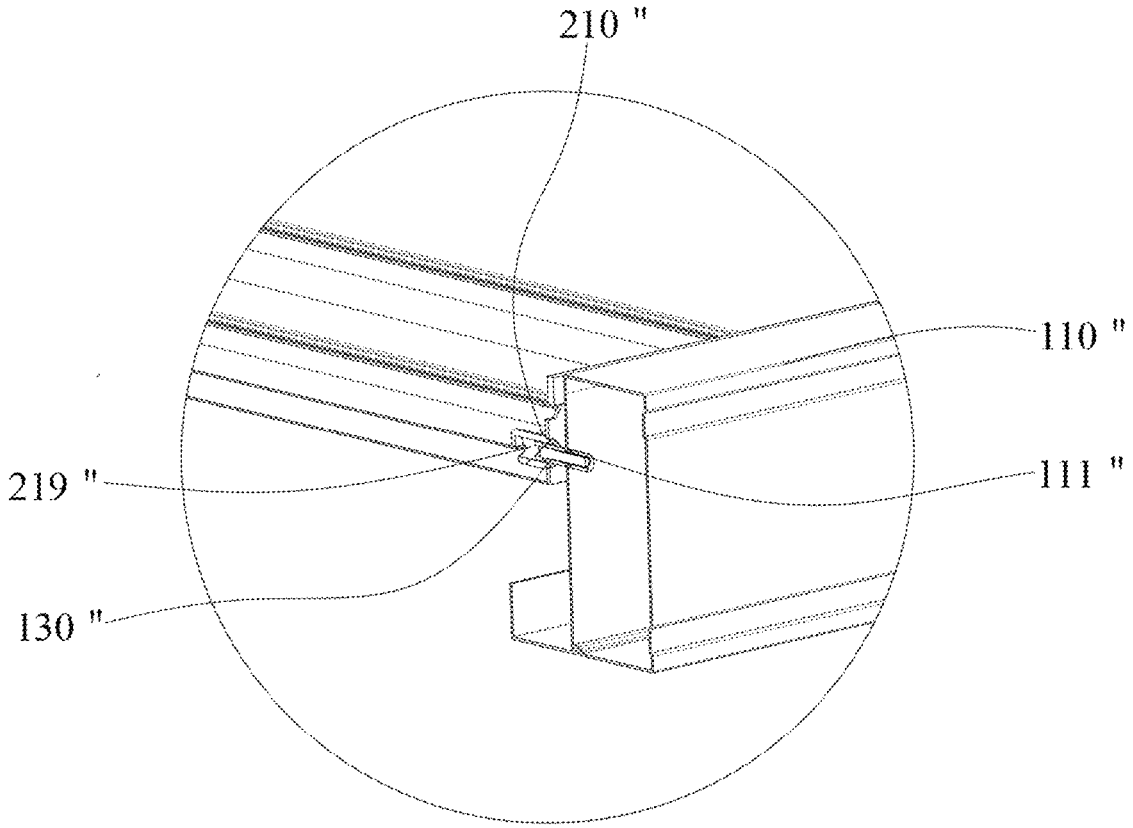
FIG. 25 is a schematic structural diagram of assembly between a louver plate and a louver rotating shaft from a sectional view in Example 3 of the present disclosure.
Figure 26:
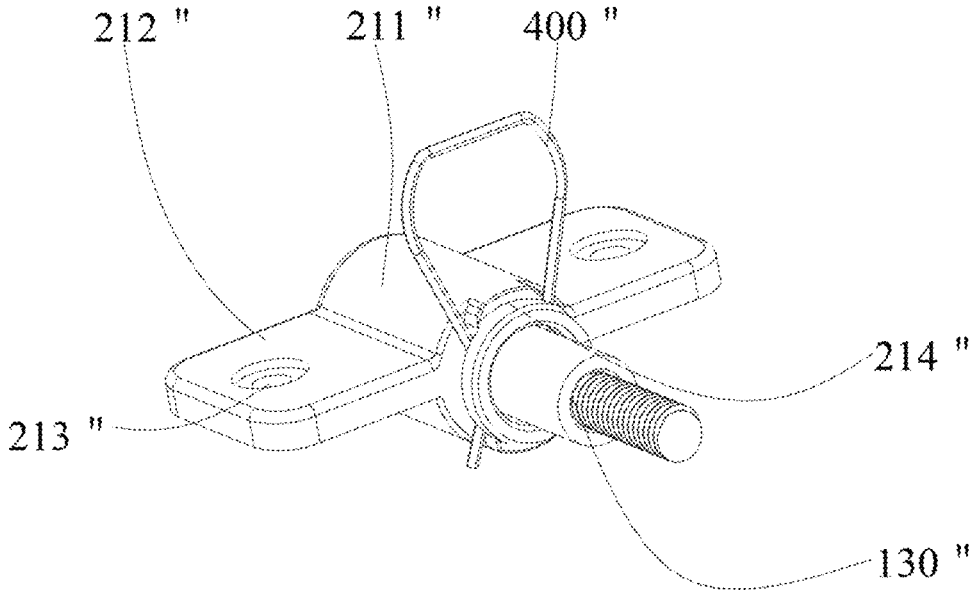
FIG. 26 is a schematic structural diagram of assembly among a louver rotating shaft, a rotating shaft seat and a clamp member in Example 3 of the present disclosure.
Figure 27:
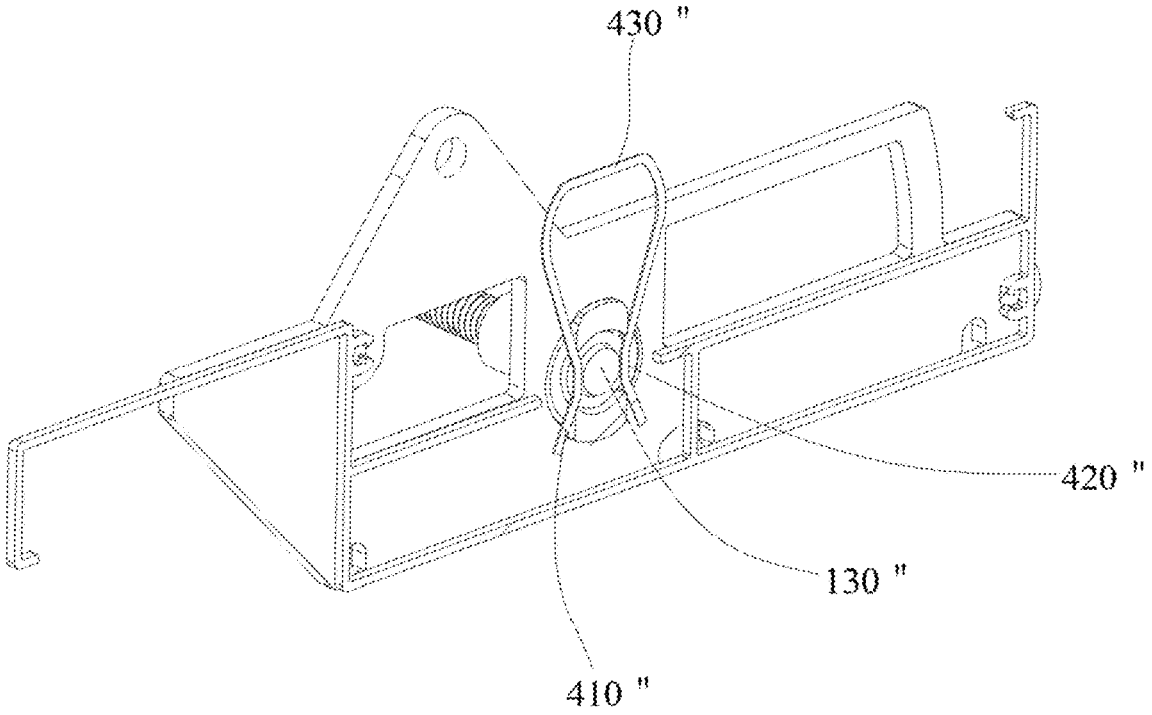
FIG. 27 is a schematic diagram of assembly from a sectional view among a louver rotating shaft, a rotating shaft seat and a clamp member in Example 3 of the present disclosure.
Figure 28:
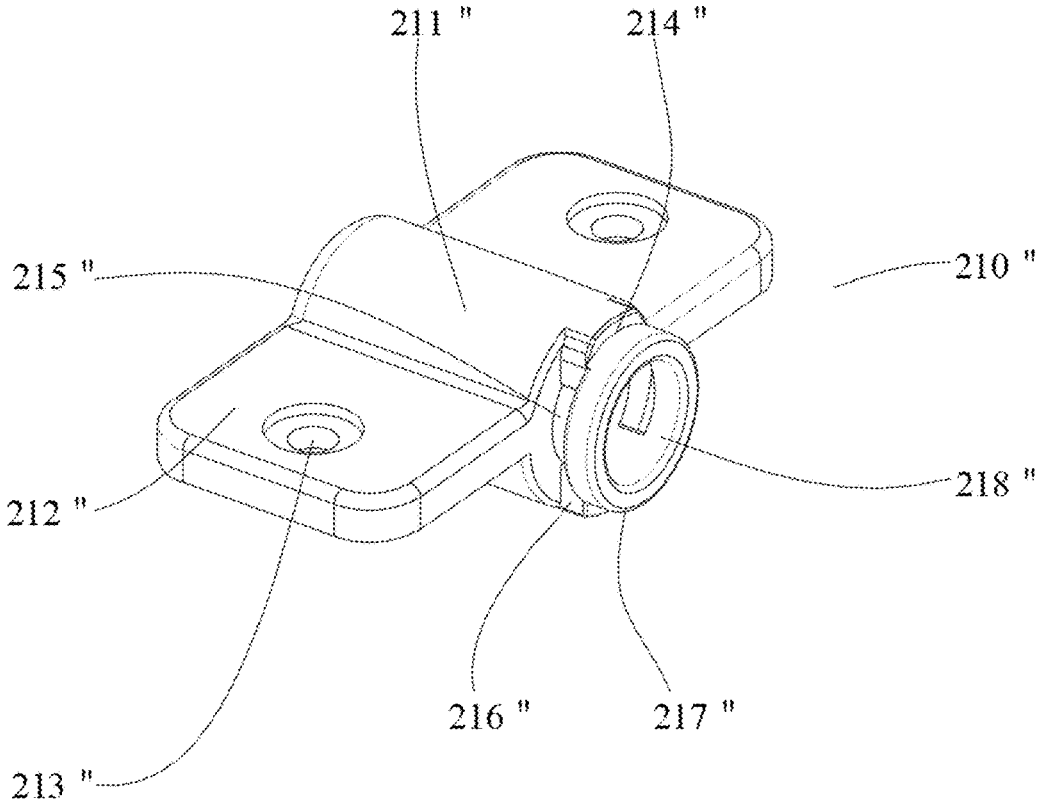
FIG. 28 is a schematic structural diagram of a rotating shaft seat in Example 3 of the present disclosure.
Figure 29:
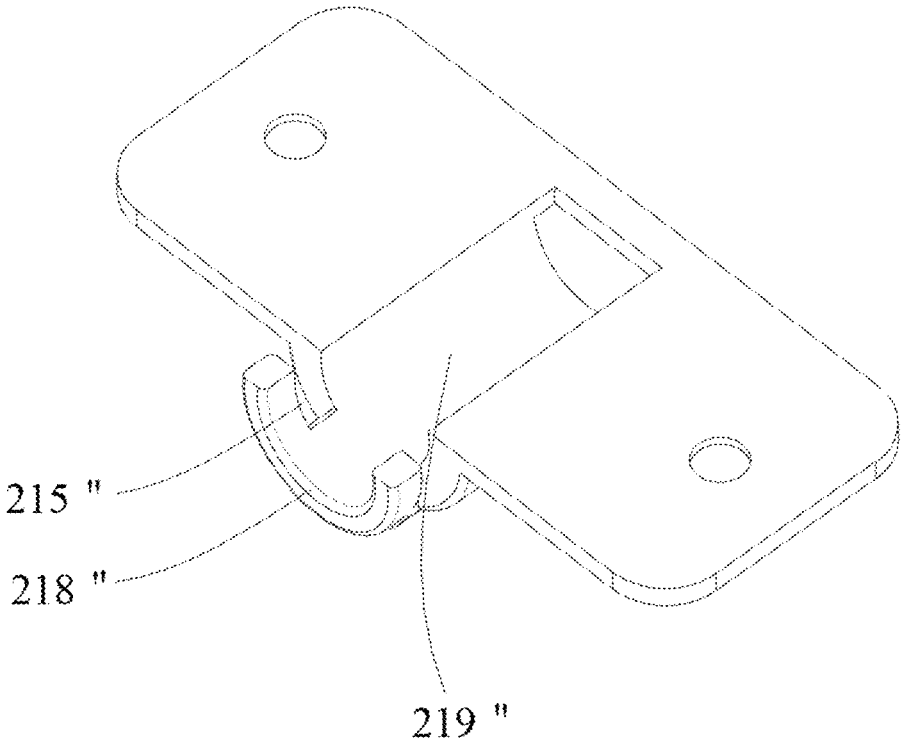
FIG. 29 is a schematic structural diagram of a rotating shaft seat from a sectional view in Example 3 of the present disclosure.
Figure 30:
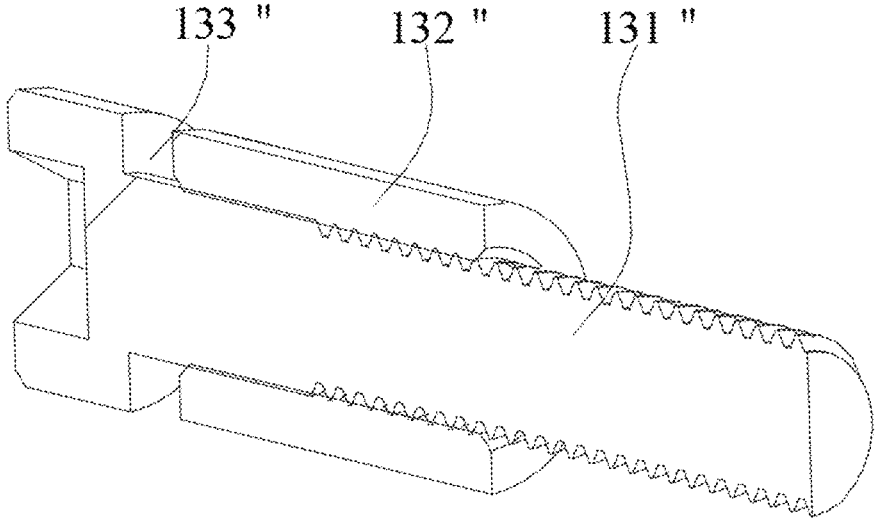
FIG. 30 is a schematic structural diagram of a louver rotating shaft from a sectional view in Example 3 of the present disclosure.

In combination with the above description, in one alternative example, as shown in FIGS. 4 and 5, the linkage member 420 is of a linkage swing arm 430, and the linkage swing arm 430 has a structure in a shape like "∠". The linkage swing arm 430 includes a pull rod connecting portion 431, a link rod connecting portion 433 and a central portion 432, where the central portion 432 is provided with a hinged shaft hole, and the hinged shaft hole is cooperatively assembled with the ring beam 120 by means of a hinged shaft. The pull rod connecting portion 431 is in hinged cooperation with the pull rod 410, and the link rod connecting portion 433 is in hinged cooperation with the linkage strip 220. The linkage strip 220 is driven by means of the movement of the swing arm in combination with up-and-down pulling of the pull rod 410.

Preferably, the pull rod 410 is located in an inner cavity of the stand column 110, and the upper end of the pull rod 410 protrudes from an upper end of the stand column 110 and extends upwards. In the rest alternative examples, the upper end of the stand column 110 is usually provided with a ring beam assembly groove, and the upper end of the pull rod 410 extends into the ring beam assembly groove.

In conclusion, the stand column 110 is provided with an alignment stroke hole 111, the alignment stroke hole 111 is used for corresponding to an outer port of the stroke cavity groove 421, and the mounting seat 420 is fixed in the inner cavity of the stand column 110, thereby facilitating mounting of the control member 310.

In a specific structure, the control member 310 includes a handle 311, a handle shaft 312 and a locking mechanism 340, the handle 311 fixedly cooperates with the handle shaft 312, the handle 311 is positioned outside the stand column 110, and the handle shaft 312 penetrates a side wall of the stand column 110 and extends into the inner cavity of the stand column 110. The handle shaft 312 is cooperatively assembled with the lower end of the pull rod 410 positioned in the inner cavity of the stand column 110, and the handle shaft 312 penetrates the stroke cavity groove 321 and is capable of stopping at any height in the stroke cavity groove 321. The handle 311 provides convenience for the user to the push and pull operation for use, and the user can push and pull the handle to drive the handle shaft 312 to move. The locking mechanism 340 is used for limiting the position of the handle shaft 312, such that the handle shaft 312 can stop at any height in the stroke cavity groove 321, thereby facilitating control over the opening and closing angle of the louver plate 210.

The locking mechanism 340 includes a lock cylinder shaft 341, the lock cylinder shaft 341 is embedded in an inner cavity of the handle shaft 312, and a locking shaft 342 penetrates the lock cylinder shaft 341. A guide hole 313 is provided in a side wall of the handle shaft 312, and the locking shaft 342 correspondingly cooperates with the guide hole 313, such that the lock cylinder shaft 341 conveniently moves axially. A limit pin 343 is arranged at an inner end of the lock cylinder shaft 341, a limit pin hole 314 is provided in the side wall of the handle shaft 312, and the limit pin 343 correspondingly cooperates with the limit pin hole 314. The locking shaft 342 is used for locking cooperation with the mounting seat 420, such that the handle shaft 312 is capable of stopping at any height in the stroke cavity groove 321. A spring cavity 346 is provided in the lock cylinder shaft 341, and a return spring 344 is arranged in the spring cavity 346. One end of the return spring 344 abuts against the locking shaft 342, and the other end of the return spring abuts against the limit pin 343. When the lock cylinder shaft 341 axially moves in the direction of the inner cavity of the stand column 110, the locking shaft 342 moves along with the movement, the locking shaft 342 abuts against with the return spring 344, and the other end of the return spring 344 abuts against the limit pin 343, such that compression is realized. The locking shaft 342 continuously moves inwards along the guide hole 313 until the locking shaft 342 is completely separated from the mounting seat 420, such that the locking mechanism 340 is in an unlocked state. In this case, the handle 311 can drive the handle shaft 312 to move up and down along the stroke cavity groove 321 in the mounting seat 420, so as to facilitate up-and-down driving of the pull rod 410.

In one preferred example, a guide rail 330 is further cooperatively arranged on the handle shaft 312, and a fixing hole 331 is provided in the guide rail 330. The handle shaft 312 penetrates through the fixing hole 331, and fixedly cooperates with the guide rail 330. The guide rail 330 fills the stroke cavity groove 321, and is capable of moving up and down along the stroke cavity groove 321, and a height size of the guide rail 330 is larger than a stroke height size of the stroke cavity groove 321. The guide rail 330 is optimized to cooperate with the handle shaft 312, such that when up-and-down movement is achieved by driving of the handle 311, guide is more accurate and effective, and the movement is more successful, more convenient and faster.

In one preferred example, at least two locking grooves 322 are provided in the mounting seat 320. When the number of the two locking grooves 322 is two, the two locking grooves are one locking groove 322 at a louver open state position and one locking groove 322 at a louver closed state position and are usually arranged up and down. An outer end of the lock cylinder shaft 341 is cooperatively provided with a button cap 345, and the button cap 345 can facilitates the operation by the user, so as to drive the lock cylinder shaft 341 to axially move. When the lock cylinder shaft 341 axially moves towards the inner cavity of the stand column 110, the locking shaft 342 is capable of being separated from the locking groove 322, and the handle shaft 312 is capable of moving up and down along the stroke cavity groove 321.

In the rest alternative examples, an outer side of the mounting seat 320 may be provided with a clamping rack, and the locking shaft 342 is used for clamping cooperation with the clamping rack, so as to achieve limiting at different height positions.

In the rest alternative examples, the locking mechanism 340 may also be replaced with other mechanical structures. For example, a trigger locking structure or a spring locking pin structure is employed.

According to the present disclosure, the overturning driving device is designed in an optimized manner, and the pull rod is driven by the control member to realize transmission. By means of hard transmission of the pull rod, the linkage strip can realize rapid linkage cooperation by means of the linkage member in combination with up-and-down movement of the control member, thereby completing overturning operation of the louver plate. The driving assembly is optimized, and up-and-down pushing operation is realized by directly using the control member, such that the operation is simpler and more effective. Different overturning angles of the louver plate can be adjusted by means of stop at different height positions.

Example 2

In combination with Example 1, as shown in FIGS. 11-21, an outdoor louvered tent is disclosed in this example. The outdoor louvered tent includes a louvered tent frame 200' and a louvered tent roof 100', and the louvered tent frame 200' includes several stand columns 210' and a ring beam frame 220' supported by means of the stand columns 210'. According to the louvered tent specification, the louvered tent may be an outdoor tent of a wall leaning structure of two stand columns 210' or an outdoor louvered tent having a structure of four stand columns 210'. The number of the stand columns 210' may also be six, eight, etc., and a single ring beam 220' or multiple ring beam frames 220' are arranged accordingly.

The ring beam frame 220' is generally a frame type structure, which is a square or rectangular frame structure, and generally includes four ring beams 221' which are mutually butted, and fixed mounting between adjacent ring beams 221' is completed by means of the stand column 210'. The louvered tent roof 100' is used for cooperating with the ring beam frame 220', and both sides of the louvered tent roof 100' are cooperatively assembled with the two ring beams 221' which are parallel to each other and corresponding, such that a louver unit 110' in the louvered tent roof 100' and the other two ring beams 221' are arranged parallel to each other.

The louvered tent roof 100' includes a plurality of louver units 110' and a linkage assembly for driving the louver units 110' to open and close. The louver unit 110' includes at least two louver plates 101', and preferably two louver plates 101' form an independent louver unit 110'. In other examples, an independent louver unit 110' may also be three louver plates 101'.

Adjacent positions of the louver plates 101' in the same louver unit 110' are in hinged cooperation to form a linkage opening-closing structure, and a linkage assembly is used for driving any louver plate 101' in the louver unit 110' to turn over, such that the other louver plates 101' in the same louver unit 110' turn over in linkage, thereby realizing opening and closing of the louver unit 110'.

In one preferred example, the number of louver plates 101' in the louver unit 110' is two, namely, a driving louver plate 111' and a driven louver plate 112'. As the louvered tent roof 100' changes from an open state to a closed state, an included angle between the driving louver plate 111' and the driven louver plate 112' in any louver unit 110' is gradually increased, and adjacent louver units 110' are separated at intervals. When the driving louver plate 111' is driven to close by the linkage assembly, the driven louver plate 112' is linked to close, and the louver plates 101' between adjacent louver units 110' are attached adjacently. When the driving louver plate 111' is driven to open by the linkage assembly, the driven louver plate 112' is linked to open, and the louver plates 101' between adjacent louver units 110' are gradually separated.

To optimize the above structural design, a single independent louver unit 110' including two louver plates 101' is employed. After the louvered tent roof 100' is opened, a light-transmission gap close to the width of two louver plates 101' can be formed between two adjacent louver units 110'. In this structure, two adjacent louver units 110' usually form a louver unit assembly, a gap formed between the louver units 110' in the same louver unit assembly is a large light-transmission gap, and a gap formed between two adjacent louver unit assemblies is a small light-transmission gap. By employing the attached opening and closing structure of the louver plates 101' in the louver unit 110', the louvered tent roof 100' has a large light-transmission gap.

Preferably, the linkage assembly includes linkage strips 310', and the linkage strips 310' are arranged in an extension manner in the arrangement direction of several louver units. One of the louver plates 101' in the louver unit 110' is hinged to the linkage strip 310' by means of a linkage seat 320'. The linkage strip 310' is at least located at one side of the louver unit 110' for realizing synchronous linkage cooperation with the louver unit 110'. Along with the reciprocating movement of the linkage strip 310', the louver plates 101' in several louver units 110' can be synchronously driven to realize opening and closing operation.

The linkage assembly further includes a sliding rail 350', and the sliding rail 350' is arranged in an extension manner in the arrangement direction of several louver units 110', and is preferably arranged on both sides of the louver unit 110', so as to facilitate the movement of the louver plates 101' in the louver unit 110' during the overturning operation, so as to improve the smoothness of overturning of the louver plates 101'. Several hinged seats 351' are arranged on the sliding rail 350', a single hinged seat 351' is used for hinged cooperation with a single louver plate 101', and preferably, hinged cooperation is achieved by means of a driving hinged shaft 330'. The louver plate 101' is a louver plate in the louver unit 100' used for cooperation with the linkage strip 310', and is usually a driving louver plate 111'. A sliding groove 352' is further provided in the sliding rail 350', the other louver plate 101' in the louver unit 110' cooperates with the sliding groove 352' by means of a guide shaft 340', and usually, the driven louver plate 112' cooperates with the sliding groove 352'. The sliding rail 350' is arranged at the inner side of the ring beam frame 220', and the sliding rail 350' is arranged at one side or two sides.

In a specific structure, the driving louver plate 111' and the hinged seat 351' cooperate in a hinged manner. By taking the hinged position as the center, the driving louver plate 111' realizes the overturning operation at the original position. Since the linkage structure of a plurality of louver plates 101' is employed in the louver unit 110', when the driving louver plate 111' realizes the overturning operation at the original position, the driven louver plate 112' needs to perform position movement. A cooperation structure of the sliding groove 352' is preferably employed, such that the driven louver plate 112' can also move accordingly when opening and closing overturning is performed, thereby realizing integral overturning and closing of the louver unit 110'.

In combination with the above description, a driving mechanism is further included. The driving mechanism preferably employs a manual driving structure, and may also employ an electric driving structure. The electric driving structure may generally be provided with a small electric motor, so as to drive the driving louver plate 111' in the louver unit 110' at the head end to turn over, and the driving louver plate 111' drives the linkage strip 310' to move, thereby synchronously driving the other louver units 110' to rotate. For the specific driving mechanism, refer to the relevant structural features in Example 1.

In another driving mechanism, the driving mechanism includes a pull rod member 410', the upper portion of the pull rod member 410' is usually used for cooperating with the louver unit 110' at the head end of the louvered tent roof 100', and can also cooperate with the louver unit 110' at other positions. The louver plate 101' at the head end of the louver unit 110' is cooperatively assembled with the pull rod member 410' by means of the linkage seat 320', and the pull rod member 410' is used for driving the louver plate to realize overturning by means of the linkage seat 320'. The louver plate 101' drives the linkage strip 310' to realize linkage overturning of the other louver units 110'. Generally, a pull rod portion 322' and a linkage portion 321' are arranged on the linkage seat 320' mounted corresponding to the louver plate 101' which cooperates with the driving mechanism. The pull rod portion 322' is used for cooperating with the pull rod member 410', the linkage portion 321' is used for cooperating with the linkage strip 310', and the linkage seats 320' cooperating with the other louver plates 101' can generally be only provided with the linkage portions 321'.

In one preferred example, an operating handle 420' is provided at a lower portion of the pull rod member 410', and the operating handle 420 can drive the pull rod member 410' to complete overturning of the louver plate 101' by means of up-and-down movement.

In one preferred example, the pull rod member 410' is arranged in the stand column 210', one end of the operating handle 420' extends into the stand column 210' to be cooperatively assembled with the pull rod member 410', and the other end of the operating handle extends to the outside of the stand column 210'. A stroke groove 211' is provided in the stand column 210', and the operating handle 420' moves up and down along the stroke groove.

In one preferred example, a wrench member 430' is arranged at the lower portion of the pull rod member 410', and the wrench member 430' cooperates with the stand column 210' by means of a rocker. A rocker base 212' is arranged on the stand column 210', and the pull rod member 410' drives the louver plate 101' to turn over by means of movement of the rocker of the wrench member 430'.

In one preferred example, the lower portion of the pull rod member 410' is provided with a lead screw portion 411', and further includes a lead screw seat. The lead screw seat includes a driving handle 412' and a lead screw main seat 413' driven by the driving handle 412', the lead screw main seat 413' is rotated by means of the driving handle 412', and the pull rod member 410' is pulled up and down. In a specific structure, generally, the driving handle 412' is cooperatively provided with a rotating shaft or a corresponding rotating gear to realize cooperation with the lead screw main seat 413', and the lead screw main seat 413' is driven to rotate by means of meshed cooperation transmission. An interior of the lead screw main seat 413' cooperates with the lead screw portion 411' in the pull rod member 410', so as to realize up-and-down lifting operation of the pull rod member 410', and the louver unit 110' is driven to turn over.

In one preferred example, the driving mechanism is an electric driving mechanism 440'. In one preferred example, a rotary motor is arranged to rotationally drive the lead screw main seat, so as to drive the lead screw portion 411' to move up and down. In one preferred example, a telescopic motor is arranged to drive the pull rod member 410' to move up and down.

According to the present disclosure, large-interval light-transmission gaps are formed between the louver plates in an open state by optimizing the louvered tent roof, and the gap interval between adjacent louver units exceeds a width size of a single louver plate. The linkage mechanism is optimized, the louver plate at the head end is utilized to drive the linkage strip to realize linkage of the rest louver plates, such that the driving mechanism is simplified, the traditional worm transmission structure is not required, mounting of the louvered tent is facilitated, and the production cost of the louvered tent is also reduced.

Example 3

In combination with Example 1, and as shown in FIGS. 22-30, an outdoor louvered tent is disclosed in this example. The outdoor louvered tent includes a louvered tent roof, and the louvered tent roof includes several louver plates 200". Several louver plates 200" are mounted in a ring beam 100", and the ring beam 100" includes end ring beams 120" and side ring beams 110". Both ends of the louver plates 200" are used for cooperating with the side ring beams 110", the end ring beams 120" are usually arranged in parallel to the louver plates 200", and located at both ends of several louver plates 200". The end ring beams 120" and the side ring beams 110" generally form a rectangular frame in which the louver plates 200" is mounted.

Several louver rotating shafts 130" are mounted on an inner side wall of the side ring beam 110", and several louver rotating shafts 130" are arranged at equal intervals in a lengthwise direction of the side ring beam 110". A single louver rotating shaft 130" is used for correspondingly mounting one end of a single louver plate 200". In a preferred structure, the inner side wall of the side ring beam 110" is provided with a rotating shaft fixing seat 111", the louver rotating shaft 130" fixedly cooperates with the rotating shaft fixing seat 111", and the rotating shaft fixing seat 111" is arranged to facilitate the preassembly of the louver rotating shaft 130".

By optimizing the above structure, the louver rotating shaft 130" is pre-assembled on the side ring beam 110", which simplifies the assembly process of the louver plate 200" and facilitates the assembly of the whole louver plate 200".

The louver plate 200" includes a louver plate body 220", louver plate end covers 230" positioned at both ends of the louver plate body 220", and rotating shaft seats 210" positioned at both ends of the louver plate body 220". The rotating shaft seat 210" is used for rotating cooperation with the louver rotating shaft 130", and at least the rotating shaft seat 210" at one end of the louver plate body 220" is provided with a clamp member 400" after cooperating with the corresponding louver rotating shaft 130". In a preferred structure, the clamp member 400" is generally arranged at one single end.

In combination with the above description, in a specific structure, both ends of the louver plate body 220" are provided with mounting grooves 221", and both sides of the mounting groove 221' are provided with fixing holes 222". The rotating shaft seat 210" includes a rotating shaft seat body 211" and fixing plates 212" positioned on both sides of the rotating shaft seat body 211", the fixing plates 212" are provided with alignment holes 213", and the alignment holes 213" are used for correspondingly cooperating with the fixing holes 222". Fixing of the rotating shaft seat is completed by means of a fastening member, and the fastening member is usually a screw member. The rotating shaft seat body 211" is clamped and embedded in the mounting groove 221", which facilitates fixing mounting of the rotating shaft seat 210" and the louver plate body 220". A rotating shaft cavity 219" is provided in the rotating shaft seat body 211", and a clamping insert seat 214" is arranged on one side of the rotating shaft seat body 211". A clamping insert groove 215" is provided in side of the clamping insert seat 214", and the clamping insert groove 215" is used for cooperating with the clamp member 400". The clamping insert seat 214" includes a rotating shaft butt seat 216" and a clamp seat 217", the rotating shaft butt seat 216" is positioned outside the clamp seat 217', and an end surface of the rotating shaft butt seat 216" is of a rotating shaft cavity port 218". The clamping insert grooves 215" are positioned on both sides of the clamp seat 217", and the clamping insert grooves 215" are in communication with the rotating shaft cavity 219". The louver plate end cover 230" is provided with a rotating shaft through hole 231", the louver rotating shaft passes through the rotating shaft through hole 231", and the rotating shaft through hole 231" is used for corresponding to the rotating shaft cavity port 218", so as to facilitate the assembly of the louver rotating shaft 130".

In combination of design of the clamp member 400", the clamp member 400" includes a clamp opening portion 410", a clamp portion 420" and a clamp body 430". The clamp portion 420" is used for correspondingly cooperating with the clamping insert groove 215", and is in clamp cooperation with the louver rotating shaft 130" positioned in the rotating shaft cavity 219" by means of the clamping insert groove 215". The louver rotating shaft 130" includes a rotating shaft body 131" and a shaft sleeve 132" arranged on the rotating shaft body 131" in a sleeving manner, a clamp groove 133" is provided between the rotating shaft body 131" and the shaft sleeve 132", and the clamp portion 420" correspondingly cooperates with the clamp groove 133".

In the above structure, the structures of the louver rotating shaft 130" and the rotating shaft seat 210" are optimized, such that aligning and embedding of the louver rotating shaft 130" and the rotating shaft seat 210" are facilitated. Moreover, the structure of the shaft sleeve 132" is optimized, such that the rotating shaft seat rotates relative to the louver rotating shaft 130" by utilizing the shaft sleeve 132", and the smoothness of overturning of the louver plate 200" is improved. In addition, that structure of the clamping insert groove 215" is optimized and designed to facilitate locking by the clamp member 400" of the rotating shaft seat 210" and the louver rotating shaft 130" after assembly, such that the mounting stability of the louver plate 200" after the assembly is completed is improved.

In one preferred example, the rotating shaft seats 210" located at both ends of the louver plate body 220" are a first rotating shaft seat **210*a*"** and a second rotating shaft seat

210*b*" respectively, and the first rotating shaft seat 210*a*" and the second rotating shaft seat 210*b*" preferably employ the same structure. In the rest examples, the first rotating shaft seat 210*a*" and the second rotating shaft seat 210*b*" may also employ different structures. The louver plate end covers 230" located at both ends of the louver plate body 220" are a first end cover 230*a*" and a second end cover 230*b*" respectively, and the first end cover 230*a*" and the second end cover 230*b*" preferably employ the same structure. In the rest examples, the first end cover 230*a*" and the second end cover 230*b*" may also adopt different structures, where the first end cover 230*a*" usually needs to be provided with a mounting hole for being cooperatively assembled with a linkage strip 300" in a cooperative manner.

In combination with the above description, the first end cover 230*a*" cooperates with the first rotating shaft seat 210*a*" adjacently, and the second end cover 230*b*" cooperates with the second rotating shaft seat 210*b*" adjacently. The first rotating shaft seat 210*a*" is cooperatively assembled with the clamp member 400" after cooperating with the corresponding louver rotating shaft 130", and the first end cover 230*a*" is cooperatively provided with the linkage strip 300". The linkage strips 300" are arranged in the lengthwise direction of a side ring beam, and the first end covers 230*a*" in several louver plates 200" are all used for being cooperatively assembled with the linkage strips 300".

According to the present disclosure, the louver plate mounting structure is optimally designed, the louver rotating shaft is pre-assembled in the side ring beam, mounting of the louver plate is realized by means of direct embedded mounting between the rotating shaft seat and the louver rotating shaft, and limiting is realized in combination with the clamp member, such that the convenience of mounting the louver plate is improved.

The above description are only preferred embodiments of the present disclosure, and are not intended to limit the present disclosure in any form. Any simple modification, equivalent change or modification made to the above examples according to the technical principle of the present disclosure still falls within the scope of the technical solution of the present disclosure.

What is claimed is:

1. An outdoor louvered tent, comprising:

a louvered tent frame and a louvered tent roof, wherein the louvered tent frame comprises several stand columns and a ring beam frame supported by the stand columns, and the louvered tent roof is arranged in the ring beam frame; and the louvered tent roof comprises several louver units and a linkage assembly for driving the louver units to open and close, each of the louver units comprises a driving louver plate and a driven louver plate, adjacent positions of the driving louver plate and the driven louver plate in a same louver unit are hinged in a cooperative manner, and the linkage assembly is arranged to driving the driving louver plate in each of the louver units to turn over, such that the driven louver plate in the same louver unit turn over in linkage, when the driving louver plate is driven to close by the linkage assembly, the driven louver plate is linked to close, and the driving louver plate and the driven louver plate between adjacent louver units are adjacent to each other; and when the driving louver plate is driven to open by the linkage assembly, the driven louver plate is linked to open, and the driving louver plate and the driven louver plate between the adjacent louver units are gradually separated, wherein as the louvered tent roof changes from an open state to a closed state, an included angle between the driving louver plate and the driven louver plate in the any louver unit of the louver units is gradually increased, and the adjacent louver units are separated at intervals, wherein the linkage assembly comprises linkage strips, the linkage strips are arranged in an extension manner in an arrangement direction of the several louver units, and a single louver plate in one of the louver units is hinged to the linkage strip by means of a linkage seat, wherein the louvered tent roof comprises an overturning driving device for driving the linkage strip to move; the overturning driving device comprises a driving assembly, the driving assembly comprises a control member and a mounting seat, the driving assembly is mounted on one of the stand columns, and a stroke cavity groove for the control member to move up and down is provided in the mounting seat; and when the control member moves up and down along the stroke cavity groove, the control member is arranged to driving the linkage assembly to move, and the linkage strip are driven to move by means of the linkage assembly.

2. The outdoor louvered tent according to claim 1, further comprising a sliding rail, wherein several hinged seats are arranged on the sliding rail, each hinged seat is hinged with the single louver plate, a sliding groove is further provided in the sliding rail, and other driving louver plates and the driven louver plates in the louver units cooperates with the sliding groove by means of a guide shaft.

3. The outdoor louvered tent according to claim 2, wherein the sliding rail is arranged at an inner side of the ring beam frame, and the sliding rail is arranged on one side or two sides.

4. The outdoor louvered tent according to claim 1, wherein the linkage assembly comprises a pull rod and a linkage member, a lower end of the pull rod is assembled with the control member, an upper end of the pull rod is assembled with the linkage member, and the linkage member is further cooperatively assembled with the linkage strip.

5. The outdoor louvered tent according to claim 4, wherein the linkage member comprises a first linkage arm, a linkage shaft and a second linkage arm, one end of the first linkage arm is assembled with the upper end of the pull rod, other end of the first linkage arm is assembled with the linkage shaft, other end of the linkage shaft is cooperatively assembled with one end of the second linkage arm, and other end of the second linkage arm is cooperatively assembled with the linkage strip.

6. The outdoor louvered tent according to claim 4, wherein the pull rod is located in an inner cavity of one of the stand columns mounted with the driving assembly, the upper end of the pull rod protrudes from an upper end of one of the stand columns mounted with the driving assembly and extends upwards, one of the stand columns mounted with the driving assembly is provided with an alignment stroke hole, the alignment stroke hole is corresponding to an outer port of the stroke cavity groove, and the mounting seat is fixed in the inner cavity of one of the stand columns mounted with the driving assembly.

7. The outdoor louvered tent according to claim 1, wherein the control member comprises a handle, a handle shaft and a locking mechanism, the handle fixedly cooperates with the handle shaft, the handle is positioned outside one of the stand columns mounted with the driving assembly, the handle shaft penetrates a side wall of one of the stand columns mounted with the driving assembly and extends into an inner cavity of one of the stand columns mounted with the driving assembly, the handle shaft is cooperatively assembled with a lower end of the pull rod positioned in the inner cavity of one of the stand columns mounted with the driving assembly, and the handle shaft penetrates the stroke cavity groove and is capable of stopping at any height in the stroke cavity groove.

8. The outdoor louvered tent according to claim 7, wherein the locking mechanism comprises a lock cylinder shaft, the lock cylinder shaft is embedded in an inner cavity of the handle shaft, a locking shaft penetrates the lock cylinder shaft, a guide hole is provided in a side wall of the handle shaft, the locking shaft correspondingly cooperates with the guide hole, a limit pin is arranged at an inner end of the lock cylinder shaft, a limit pin hole is provided in the side wall of the handle shaft, the limit pin correspondingly cooperates with the limit pin hole, and the locking shaft is connected with the mounting seat, such that the handle shaft is capable of stopping at any height in the stroke cavity groove.

9. The outdoor louvered tent according to claim 8, wherein a spring cavity is provided in the lock cylinder shaft, a return spring is arranged in the spring cavity, one end of the return spring abuts against the locking shaft, and other end of the return spring abuts against the limit pin; a guide rail is further cooperatively arranged on the handle shaft, the guide rail fills the stroke cavity groove, and is capable of moving up and down along the stroke cavity groove, and a height size of the guide rail is larger than a stroke height size of the stroke cavity groove; at least two locking grooves are provided in the mounting seat, and an outer end of the lock cylinder shaft is cooperatively provided with a button cap; and when the lock cylinder shaft axially moves towards an inner cavity of one of the stand columns mounted with the driving assembly, the locking shaft is capable of being separated from the locking groove, and the handle shaft is capable of moving up and down along the stroke cavity groove.

10. The outdoor louvered tent according to claim 1, wherein the driving louver plate and the driven louver plates are cooperatively assembled with the ring beam, the ring beam comprises end ring beams and side ring beams, two ends of each of the driving louver plate and the driven louver plates are connected with the side ring beams, several louver rotating shafts are mounted on inner side walls of the side ring beams, each of the driving louver plate and the driven louver plates comprises a louver plate body, louver plate end covers positioned at two ends of the louver plate body, and rotating shaft seats positioned at the two ends of the louver plate body, the rotating shaft seats are connected with the several louver rotating shafts, and at least the rotating shaft seat at one end of the louver plate body cooperates with corresponding louver rotating shaft and then is provided with a clamp member; and a rotating shaft fixing seat is arranged on the inner side wall of the side ring beam, and the louver rotating shaft fixedly cooperates with the rotating shaft fixing seat.

11. The outdoor louvered tent according to claim 10, wherein both ends of the louver plate body are provided with mounting grooves, both sides of the mounting groove each are provided with a fixing hole, the rotating shaft seat comprises a rotating shaft seat body and fixing plates located on both sides of the rotating shaft seat body, alignment holes are provided in the fixing plates, the alignment holes are corresponding with the fixing holes, and the rotating shaft seat body is clamped and embedded in the mounting groove.

12. The outdoor louvered tent according to claim 11, wherein a rotating shaft cavity is provided in the rotating shaft seat body, a clamping insert seat is arranged at one side of the rotating shaft seat body, a clamping insert groove is provided at one side of the clamping insert seat, and the clamping insert groove is connected with the clamp member.

13. The outdoor louvered tent according to claim 12, wherein the clamping insert seat comprises a rotating shaft butt seat and a clamp seat, the rotating shaft butt seat is positioned outside the clamp seat, an end surface of the rotating shaft butt seat is of a rotating shaft cavity port, the clamping insert groove are positioned on both sides of the clamp seat, and the clamping insert groove are in communication with the rotating shaft cavity; and a rotating shaft through hole is provided in each of the louver plate end covers, a louver rotating shaft penetrates the rotating shaft through hole, and the rotating shaft through hole is corresponding to the rotating shaft cavity port.

14. The outdoor louvered tent according to claim 12, wherein the clamp member comprises a clamp opening portion, a clamp portion and a clamp body, wherein the clamp portion is corresponding with the clamping insert groove and is in clamp with the louver rotating shaft positioned in the rotating shaft cavity by means of the clamping insert groove.

15. The outdoor louvered tent according to claim 14, wherein the louver rotating shaft comprises a rotating shaft body and a shaft sleeve arranged on the rotating shaft body in a sleeving manner, a clamp groove is provided between the rotating shaft body and the shaft sleeve, and the clamp portion correspondingly cooperates with the clamp groove.

16. The outdoor louvered tent according to claim 13, wherein the rotating shaft seats positioned at the two ends of the louver plate body are a first rotating shaft seat and a second rotating shaft seat respectively, the louver plate end covers positioned at the two ends of the louver plate body are a first end cover and a second end cover respectively, the first end cover adjacently cooperates with the first rotating shaft seat, the second end cover adjacently cooperates with the second rotating shaft seat, the first rotating shaft seat cooperates with the corresponding louver rotating shaft and then is provided with the clamp member, and the linkage strip is cooperatively arranged on the first end cover.

* * * * *